US006003702A

United States Patent [19]

Grimard et al.

[11] Patent Number: 6,003,702

[45] **Date of Patent: *Dec. 21, 1999**

[54] VIAL WITH RESEALABLE CONNECTOR ASSEMBLY HAVING A MEMBRANE AND A MULTI-CONFIGURATION FLUID ACCESS DEVICE

[75] Inventors: Jean-Pierre Grimard, Vif; Jean-Claude Thibault, Saint Egreve, both of France

[73] Assignee: Becton Dickinson France, S.A., France

[ * ] Notice: This patent is subject to a terminal disclaimer.

[21] Appl. No.: 08/534,519

[22] Filed: Sep. 27, 1995

Related U.S. Application Data

[63] Continuation of application No. 08/534,519, Sep. 27, 1995.

[51] Int. Cl.[6] ..... B65B 1/06; B65D 39/00; B65D 45/30

[52] U.S. Cl. ..... 215/307; 141/24; 141/319; 215/301; 215/274; 215/DIG. 3; 604/91

[58] Field of Search ..... 215/301, 299, 215/307, 310, 231, 329, 270, 274, 275, 302, 349, 350, DIG. 3; 220/367.1, 368, 254, 203.07, 203.11, 203.15, 203.16, 203.17; 604/411–416, 89, 90, 91; 128/760; 141/23, 24, 26, 27, 312, 319, 349, 350, 383, 386

[56] References Cited

U.S. PATENT DOCUMENTS

| | | | |
|---|---|---|---|
| 2,607,503 | 8/1952 | Sonnenberg . | |
| 2,953,132 | 9/1960 | Richter et al. . | |
| 3,108,590 | 10/1963 | Gorman | 128/200.23 |
| 3,164,303 | 1/1965 | Trautmann | 604/89 X |
| 3,206,080 | 9/1965 | Scislowicz . | |
| 3,356,093 | 12/1967 | Mohahon | 141/349 |
| 3,357,427 | 12/1967 | Wittke et al. | 141/27 X |
| 3,674,028 | 7/1972 | Ogle . | |
| 3,779,371 | 12/1973 | Rovinski | 604/90 X |
| 3,838,689 | 10/1974 | Cohen | 604/90 |
| 4,210,255 | 7/1980 | Pan | 220/203.15 |
| 4,672,996 | 6/1987 | Floyd et al. | 220/203.11 X |
| 4,822,351 | 4/1989 | Purcell . | |
| 5,291,991 | 3/1994 | Meyer . | |
| 5,348,548 | 9/1994 | Meyer et al. . | |
| 5,352,196 | 10/1994 | Haber et al. | 604/90 |
| 5,358,501 | 10/1994 | Meyer . | |
| 5,360,413 | 11/1994 | Leason et al. . | |
| 5,423,791 | 6/1995 | Bartlett . | |
| 5,425,465 | 6/1995 | Healy . | |
| 5,429,256 | 7/1995 | Kestenbaum . | |
| 5,494,170 | 2/1996 | Burns . | |
| 5,702,019 | 12/1997 | Grimard | 215/301 |
| 5,879,345 | 3/1999 | Aneas . | |
| 5,891,129 | 4/1999 | Daubert et al. . | |

FOREIGN PATENT DOCUMENTS

| | | |
|---|---|---|
| 0 406 374 B1 | 8/1993 | European Pat. Off. . |
| 769 456 A2 | 4/1997 | European Pat. Off. . |

(List continued on next page.)

*Primary Examiner*—Allan N. Shoap
*Assistant Examiner*—Niki M. Eloshway
*Attorney, Agent, or Firm*—Allen W. Wark

[57] ABSTRACT

A resealable vial featuring a fluid access device having a membrane for selectively opening or sealing a fluid passageway between the bottle and the fluid access device. The vial includes a body disposed on said bottle. The fluid access device can be configured as a spike assembly, a needle assembly, or a luer lock assembly, and features a hollowed rod in sliding, fluid-tight relation to an orifice defined by the body. A membrane, preferably formed from an elastomeric material, is secured across both the orifice and the open top of the bottle, and may be retained between the top surface of the bottle and the body. The membrane preferably includes a central area sealing the orifice from the open top of the bottle, with one or more fluid passages defined on a portion of the membrane outside of the central area. A force exerted upon the hollowed rod deflects the membrane towards the interior of the vial, urging the membrane and fluid openings away from the body to open the fluid path between the bottle and the orifice. A sealing rib may be provided around the portion of the periphery of the recess for sealing contact between the central area of the membrane and the orifice.

24 Claims, 21 Drawing Sheets

FOREIGN PATENT DOCUMENTS

| | | |
|---|---|---|
| 1071487 | 3/1954 | France . |
| 1487413 | 5/1967 | France . |
| 3618158 | 10/1987 | Germany . |
| 501 172 | 2/1971 | Switzerland . |
| WO 95/03841 | 2/1995 | WIPO . |
| WO 97/39720 | 10/1997 | WIPO . |
| WO 98/13006 | 4/1998 | WIPO . |

VIAL WITH RESEALABLE CONNECTOR ASSEMBLY HAVING A MEMBRANE AND A MULTI-CONFIGURATION FLUID ACCESS DEVICE

CROSS-REFERENCE TO RELATED APPLICATIONS

This application is a continuation of application Ser. No. 08/534,519, filed Sep. 27, 1995.

I. FIELD OF THE INVENTION

The invention relates to a vial having a resealable connector assembly, and more particularly, to a vial with a resealable connector assembly employing a membrane and a multi-configuration fluid access device for efficient transfer of fluid to or from the vial.

II. BACKGROUND

Dry drugs such as powdered or lyophilized drugs are typically stored in sealed bottles or vials. In practice, the drug is accessed shortly prior to use by rupturing or piercing the seal provided on the vial. A solvent solution such as saline is then introduced into the vial to reconstitute the powdered or lyophilized drug. Once reconstituted, the drug solution is extracted from the vial for use.

Some prior art vials of powdered or lyophilized drugs include a pierceable membrane secured across the open top of the prior art vial. The membrane is normally pierced by a needle in communication with the solvent. However, care must be taken to avoid the separation of membrane fragments when the seal is pierced, as these may be accidentally delivered to the patient. These seals typically must be pierced each time access to the solvent is desired, heightening the problems associated therewith.

Other prior art vials include rubber stoppers that are removed from or urged into the vial when delivering the solvent for reconstituting the drug. While in general these assemblies work well to safely store a lyophilized drug prior to reconstitution and use, the stoppers normally cannot be accessed once they have fallen into the vial; hence, these vials normally cannot be resealed employing the stopper originally provided. This may be problematic, for instance, where a practitioner may not desire or need to administer the entire dose of reconstituted drug held in the vial; the vial would typically need to be resealed against the ambient environment to preserve the sterility of the drug remaining in the vial. Thus, the structure of these prior art vials is not readily adapted to a vial capable of repeated opening and closing.

Stoppers are normally formulated from materials selected for compatibility with the drug stored in the vial. Hence, the stoppers typically pose no harm to the safety of the drug, whether lyophilized or reconstituted. However, the appearance of a stopper within the interior of the vial often leads to the perception—however flawed—that the drug will be adversely affected by the presence of the stopper. There may also be a perception that the presence of the stopper within the vial impedes good flow of the drug solution.

III. SUMMARY OF THE INVENTION

A resealable connector assembly for a vial or bottle is provided for resealable fluid access to and from the interior of a medical storage bottle. The assembly permits a practitioner repeated access to the drug held in the bottle while at the same time preserving its sterility. The bottle includes an interior, an open top in fluid communication with the interior, and a top surface disposed around portions of the bottle surrounding the open top. The top surface may be formed, for instance, as an annular rim around the open top.

The resealable connector assembly features a body disposed on the top surface of the bottle. The body defines an orifice having a fluid path to and from the open top of the bottle.

The resealable connector assembly further includes a membrane disposed between the open top of the bottle and the orifice defined by the body. The membrane, which may be formed from an elastomeric material such as various elastomers, natural or synthetic rubbers, or the like, preferably includes a central area having a width at least equal to the width defined by the orifice. One or more openings or slits are disposed outside the central area to establish in resealable fashion the fluid path between the orifice and the open top of the bottle.

One or more sealing ribs may be disposed on the body about the periphery of the orifice. The sealing ribs are preferably disposed for sealing contact with the membrane between the central area and the one or more openings. If desired, the sealing ribs may be provided on the membrane itself. The membrane is displaceable between a sealing position, wherein the one or more sealing ribs engage the membrane between the central area and the one or more openings to close the fluid path, and an open position, wherein the one or more ribs are urged away from the membrane, opening the fluid path between the orifice and the open top of the bottle.

The membrane may be supported between the body and the top surface of the bottle and held in place, for instance, by an annular clip retaining the body to the top surface of the bottle. If desired, the body and top surface of the bottle may be formed as an integral component, with the membrane secured in the integral component so as to be disposed between the recess and the open top of the bottle.

A fluid access device is provided for fluid flow to and from the open top of the bottle. The fluid access device can be configured in a variety of configurations readily interchangeable with the structure of the body. For example, the fluid access device can be configured as a needle assembly, a spike assembly, or a luer lock assembly, each featuring as a common component a hollowed rod slidably disposed within the orifice. The hollowed rod includes a distal end disposed for contact with the membrane, and a proximal end to which a needle, spike, or luer lock may be affixed depending upon the configuration desired for the fluid access device.

The hollowed rod includes at least one fluid path communicating the distal end of the rod with the needle, spike, or luer lock affixed to the proximal end of the rod. The distal end of the rod may be sloped to allow fluid flow between the distal end of the rod and the surface of the membrane. One or more sealing gaskets may be circumferentially provided around the hollowed rod that are engageable with complimentary locking ribs provided about the orifice. The sealing gaskets on the hollowed rod provide sealing capacity while the locking ribs permit the fluid access device to be retained in storage or activated positions corresponding to the closed or open positions assumed by the membrane.

If desired, where the fluid access device is configured with a luer-lock hub, a luer lock seal may be provided. The luer lock seal serves to preserve sterility and prevents inadvertent access to the interior of the bottle until use is desired. Also, various caps, spike or needle shields, or the like can be incorporated.

In use, any caps, shields or external seals (if provided) are removed by the practitioner, so that the fluid access device is exposed for access by a source of fluid, such as an I.V. vial. The fluid source will exert a force against the fluid access device, such that the hollowed rod will disengage from its storage position towards its activated position, displacing the membrane towards its open position. The one or more ribs will be displaced from their sealing contact with the body, opening the fluid path between the orifice and the open top of the bottle, and thereby permitting fluid flow between the fluid source and the interior of the bottle via the hollowed rod and the fluid path defined between the hollowed rod and the open top of the bottle. When a desired amount of fluid has been delivered to the interior of the bottle, the fluid source may be removed, allowing delivery of the contents of the bottle via the fluid access device. The fluid access device may thereafter be urged upwards towards its storage position, allowing the membrane to redeflect towards its closed position, such that the one or more ribs will re-dispose for sealing contact with the membrane, closing the fluid path.

IV. BRIEF DESCRIPTION OF THE DRAWINGS

The invention will now be described in greater detail by way of reference to the appended drawings, wherein.

V. DETAILED DESCRIPTION OF THE PREFERRED EMBODIMENTS

While the description and figures herein makes reference to use of the connector assembly with a vial or bottle, it will be understood and appreciated by the skilled artisan that any type of container normally employed in the field of endeavor, such as capsules, jars or like vessels, are readily amenable to the advantages described herein. In addition, while herein described with regard to containers having a quantity of dry drug or medicament for reconstitution by liquid obtained from an external fluid source, it will be appreciated by the skilled artisan that the invention is not so limited. For instance, the invention may be applied to containers holding a quantity of liquid medication, wherein repeated access is desired by a user.

A convention employed in this application is that the term "distal" refers to the direction furthest from a practitioner, while the term "proximal" refers to the direction closest to the practitioner.

Figure 1:
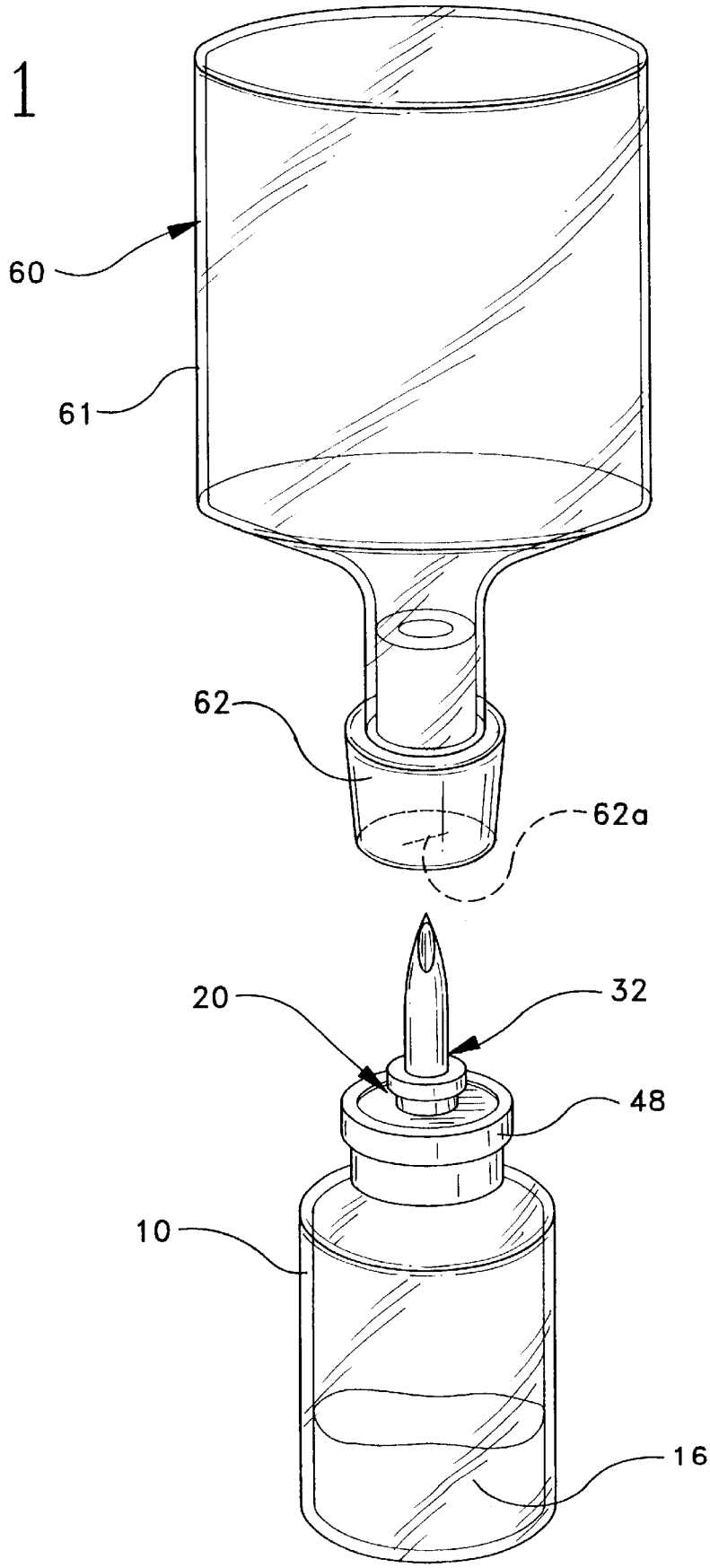
FIG. 1 is a blow-up view in perspective of a resealable bottle assembly affixed to a bottle containing therein a drug, with a source of fluid such as an I.V. vial employed to deliver fluid to the drug.
Figure 2:
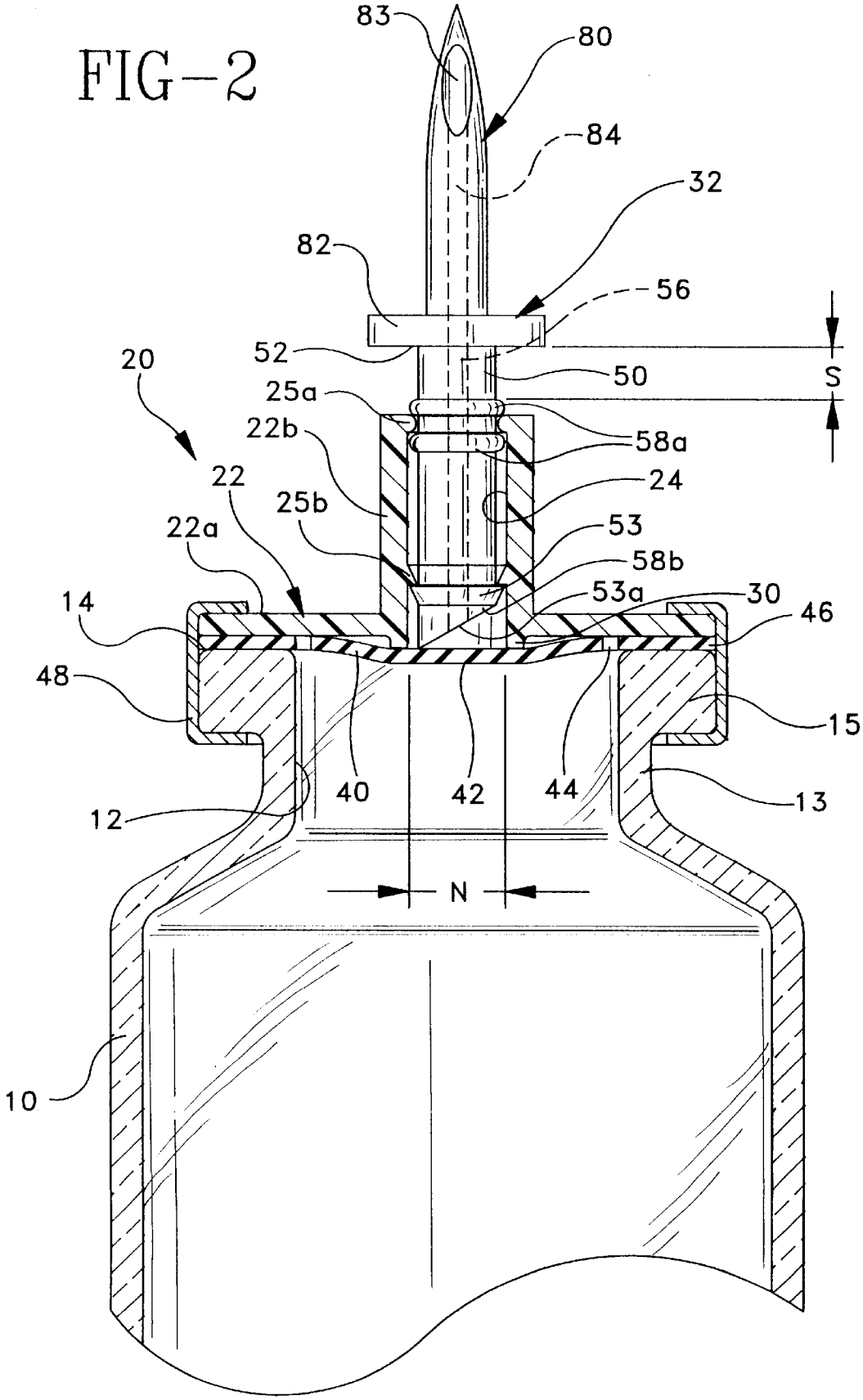
FIG. 2 is a cut-away view depicting one embodiment of a resealable bottle assembly in accordance with the invention.
Figure 3:
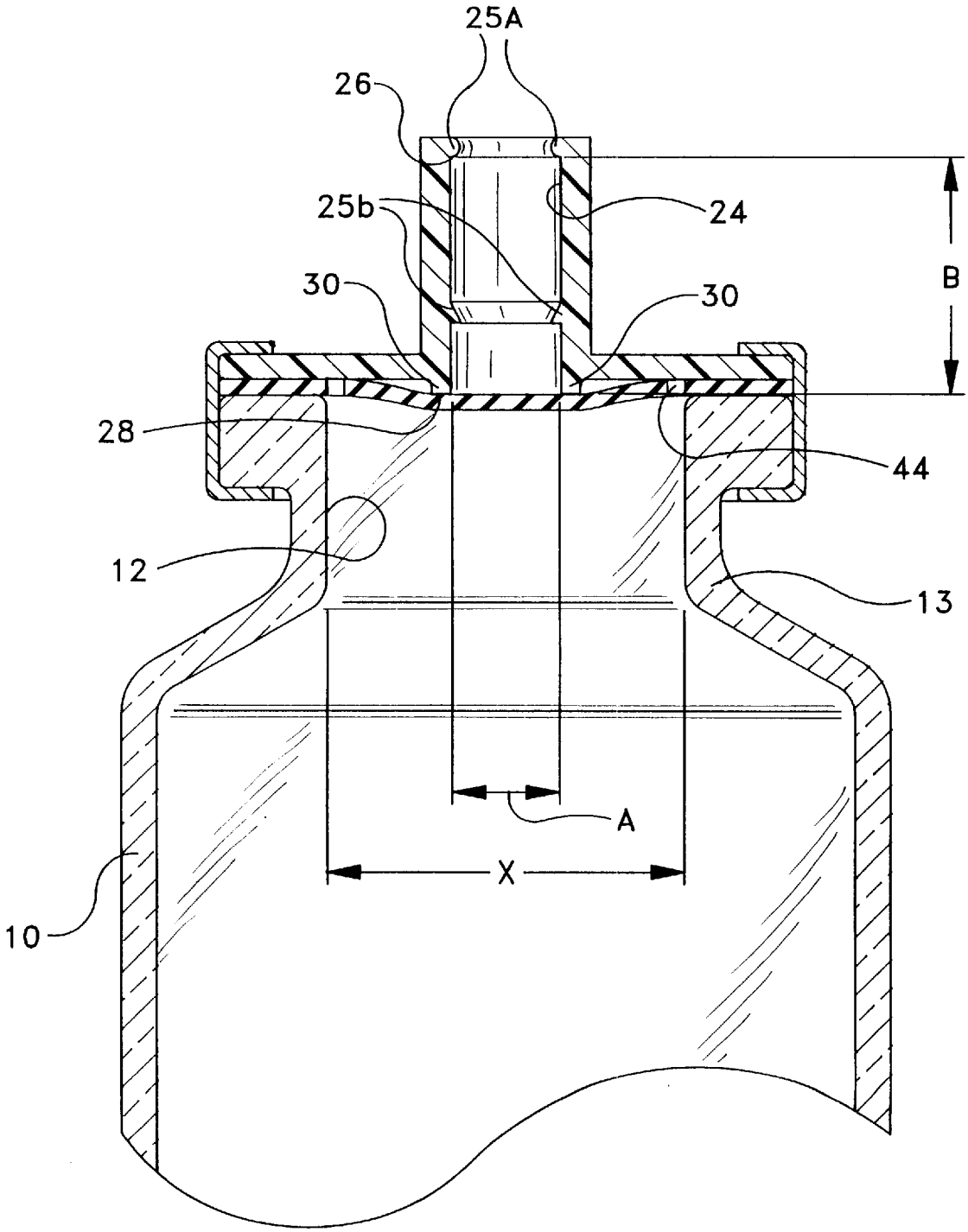
FIG. 3 is a second, partial cut-away view of the resealable bottle assembly depicted in FIG. 2.

Turning now to the drawings, wherein like numerals depict like components, FIG. 1 is an exploded perspective view of resealable bottle assembly 20 mounted to a bottle or vial 10 containing therein a drug 16. Drug 16 may entail, for instance, a medicament in powdered or granular form, such as a lyophilized medicament, intended to be reconstituted by a fluid introduced into vial 10 by a source of fluid such as I.V. bottle 60. Alternately, it will be appreciated by the skilled artisan that drug 16 may entail a liquid medicament to which repeated access by the practitioner is desired. I.V. vial 60 may feature a rubber plug or stopper 62 permitting penetration by a fluid access device 32 associated with the resealable bottle assembly 20, as will be more fully described herein. Stopper 62 may be of the pierceable type, or, as the skilled artisan will appreciate, may feature a pre-slit opening 62*a*. As the skilled artisan will appreciate, the body 61 of I.V. bottle 60 can be formed of soft or hard plastics, glasses, or the like.

As will be evident from the various drawings, bottle 10 may include a neck portion 13 defining an open top 12 with a width "X". Bottle 10 further preferably includes a top surface 14 disposed around open top 12. In the configuration depicted herein, top surface 14 is defined by an uppermost portion of an annular rim 15 formed around open top 12 of the bottle. It will be realized by the skilled artisan that the top surface of the bottle may also be established by rings or other means attached about open top 12 of the bottle.

Figure 12:
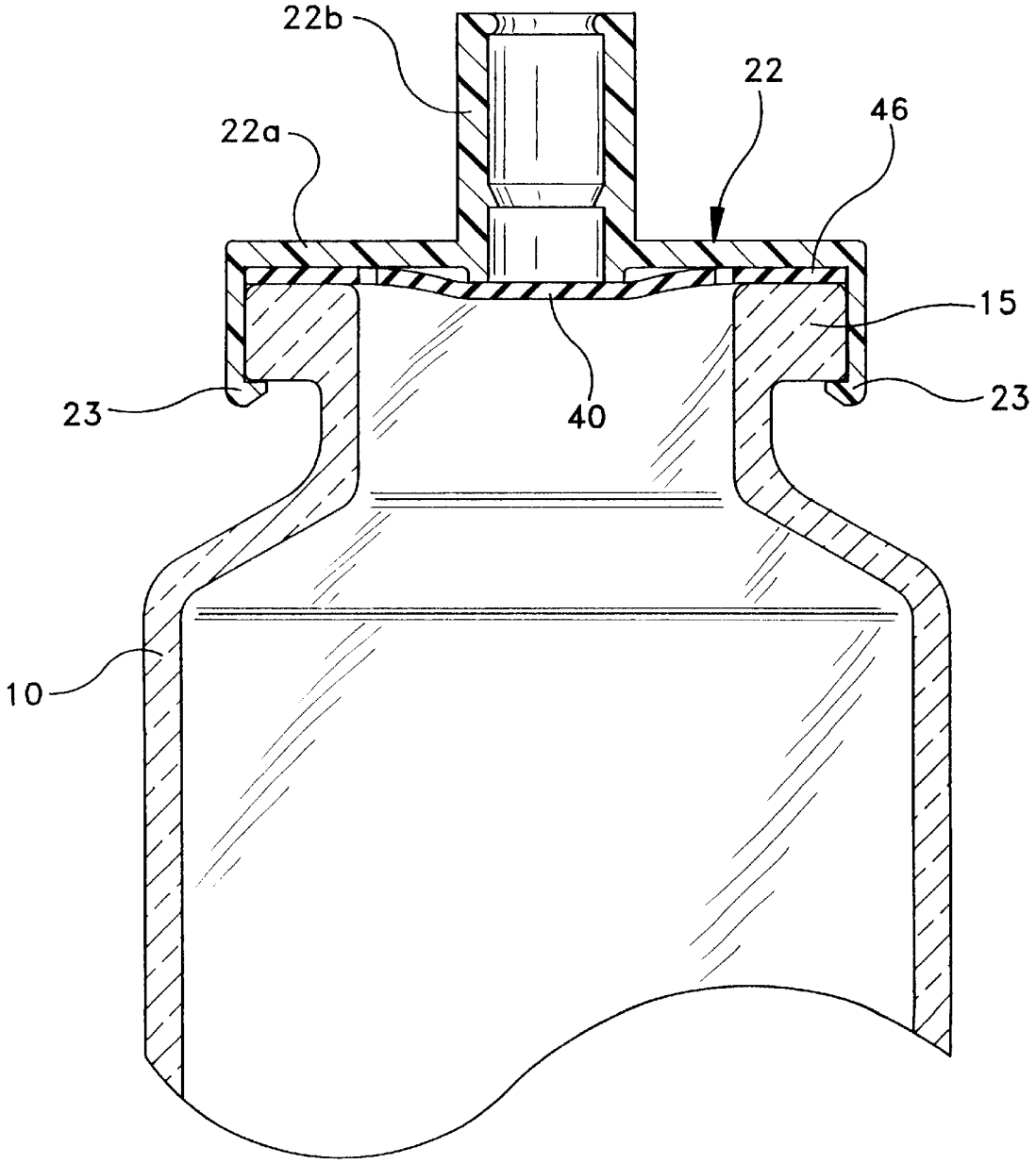
FIG. 12 depicts retention of the body to the bottle by a clip-like structure incorporated with the body.

FIGS. 2–7 depict one embodiment 20 of the resealable bottle assembly in accordance with the present invention. Resealable bottle assembly 20 features a body 22 having a relatively flat portion 22*a* and an upwardly extending portion 22*b*. As illustrated, upwardly extending portion 22*b* defines therein a relatively elongate orifice 24. As shown in FIGS. 2–7, body 22 may be formed separate from bottle 10, and attached to top surface 14 of the bottle by securing flat portion 22*a* to annular rim 15 with a crimp cap 48. In lieu of a crimp cap, flat portion 22*a* may feature downwardly extending clips 23 designed to grip the underside of annular rim 15 (see FIG. 12). It will also be evident to the skilled artisan that in lieu of a body separately supplied, body 22 may be unitarily formed with bottle 10. For instance, body 22 and, in particular, flat portion 22*a*, may define a contiguous extension of annular rim 15.

Orifice 24 includes a top end 26 and a bottom end 28, and defines a height "B" and a width "A". Bottom end 28 of the orifice is disposed for fluid communication with open top 12 of bottle 10. Width "A" of the orifice is preferably less than width "X" defined by open top 12 of the bottle. For purposes which will be hereinafter more fully described, a sealing rib 30 may be provided about the periphery of bottom end 28 of the orifice.

Resealable bottle assembly 20 preferably features a membrane 40 which is displaceable between an open position (FIG. 4) and a closed position (FIGS. 2, 5) relative to body 22. In the open position of the membrane, a fluid path 54 is opened between orifice 24 and open top 12 of the bottle, permitting free fluid flow between vial 60 and the interior of bottle 10. Likewise, fluid path 54 is closed when membrane 40 is returned to its closed position, preventing fluid flow between the orifice and the open top of the bottle, and isolating the interior of bottle 10 from the ambient environment.

As depicted in FIGS. 2, 3, 5 and 6, membrane 40, which may be formed from an elastomeric material such as various thermoplastic elastomers, natural or synthetic rubbers, or the like, can be configured in a roughly cylindrical, planar manner. Membrane 40 includes an edge 46 securable between flat portion 22*a* of the body and top surface 14 of the bottle, for instance, by the force exerted by crimp cap 48. Membrane 40 preferably includes a central area 42 having a width "N" at least equal to width "A" of orifice 24. Thus, when the membrane is secured to bottle 10, central area 42 is disposed fully across bottom end 28 of the orifice.

Figure 17:
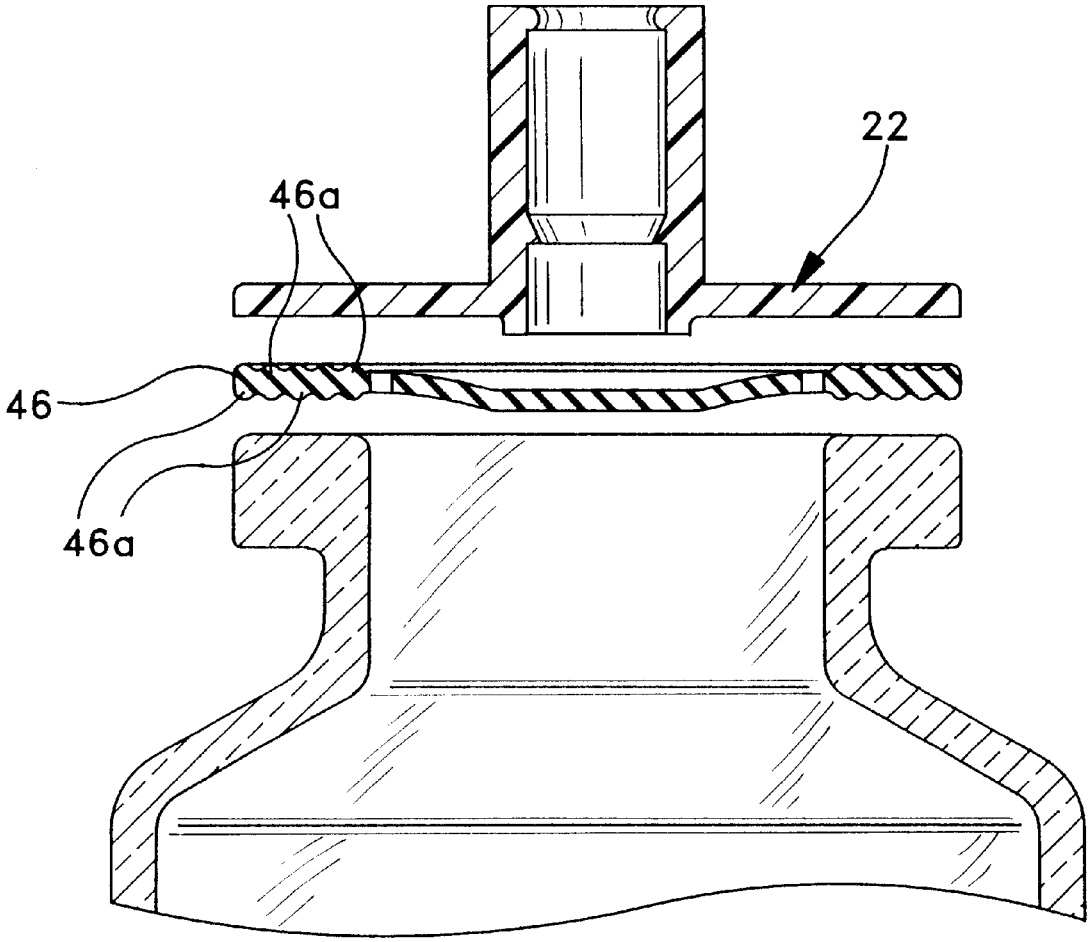
FIGS. 17–20 depict various structures for enhancing retention of the membrane between the body and top surface of the bottle.
Figure 18:
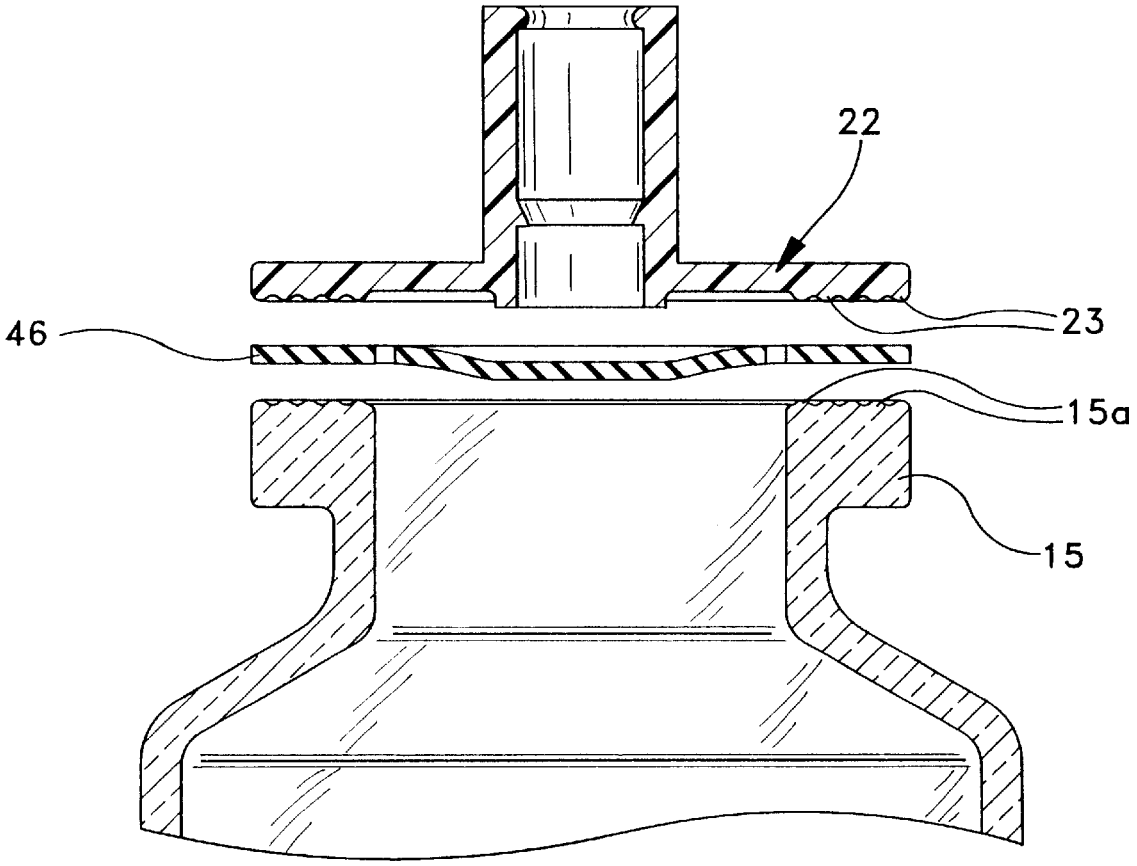
Figure 19:
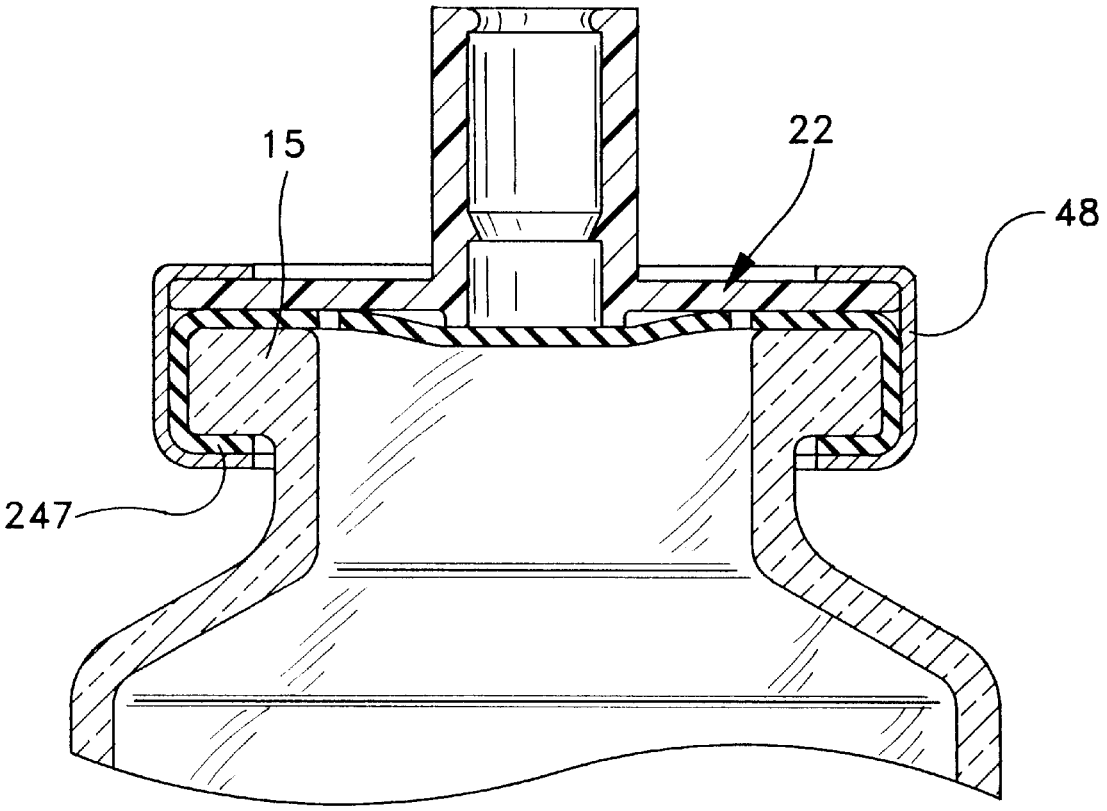
Figure 20:
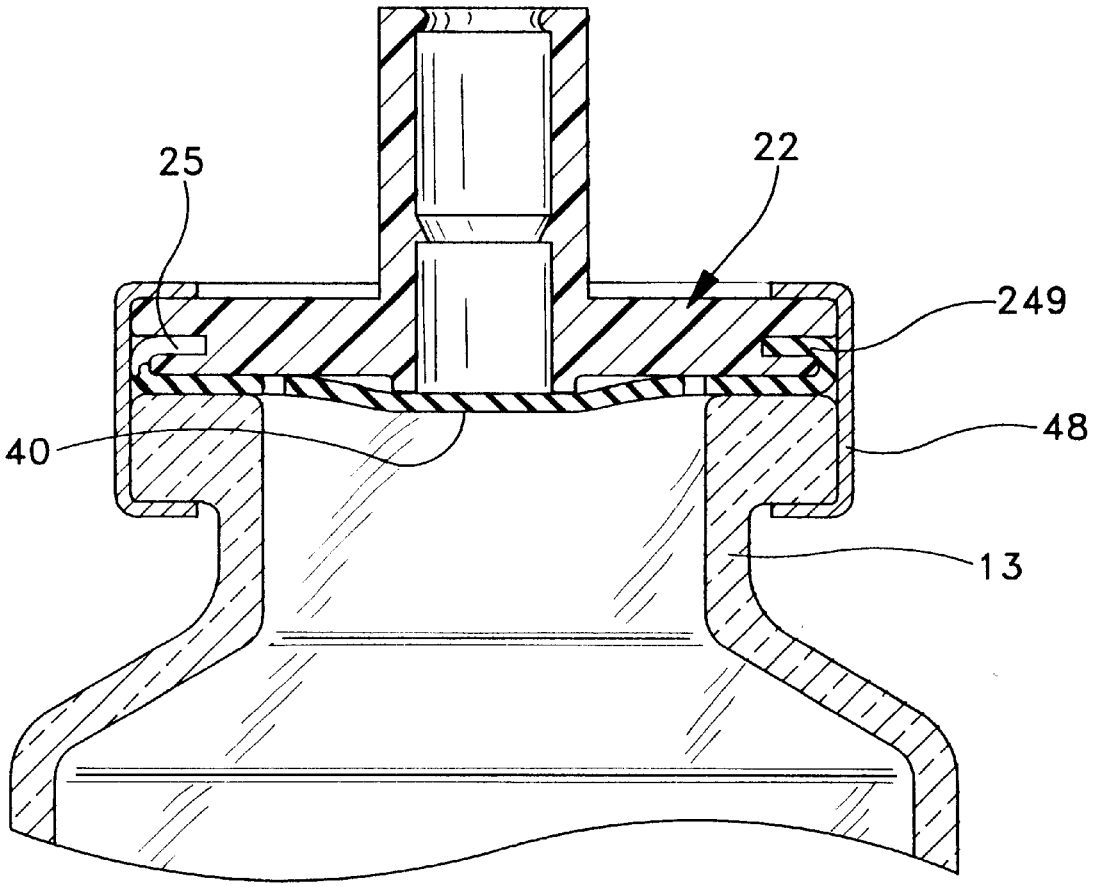
Figure 21:
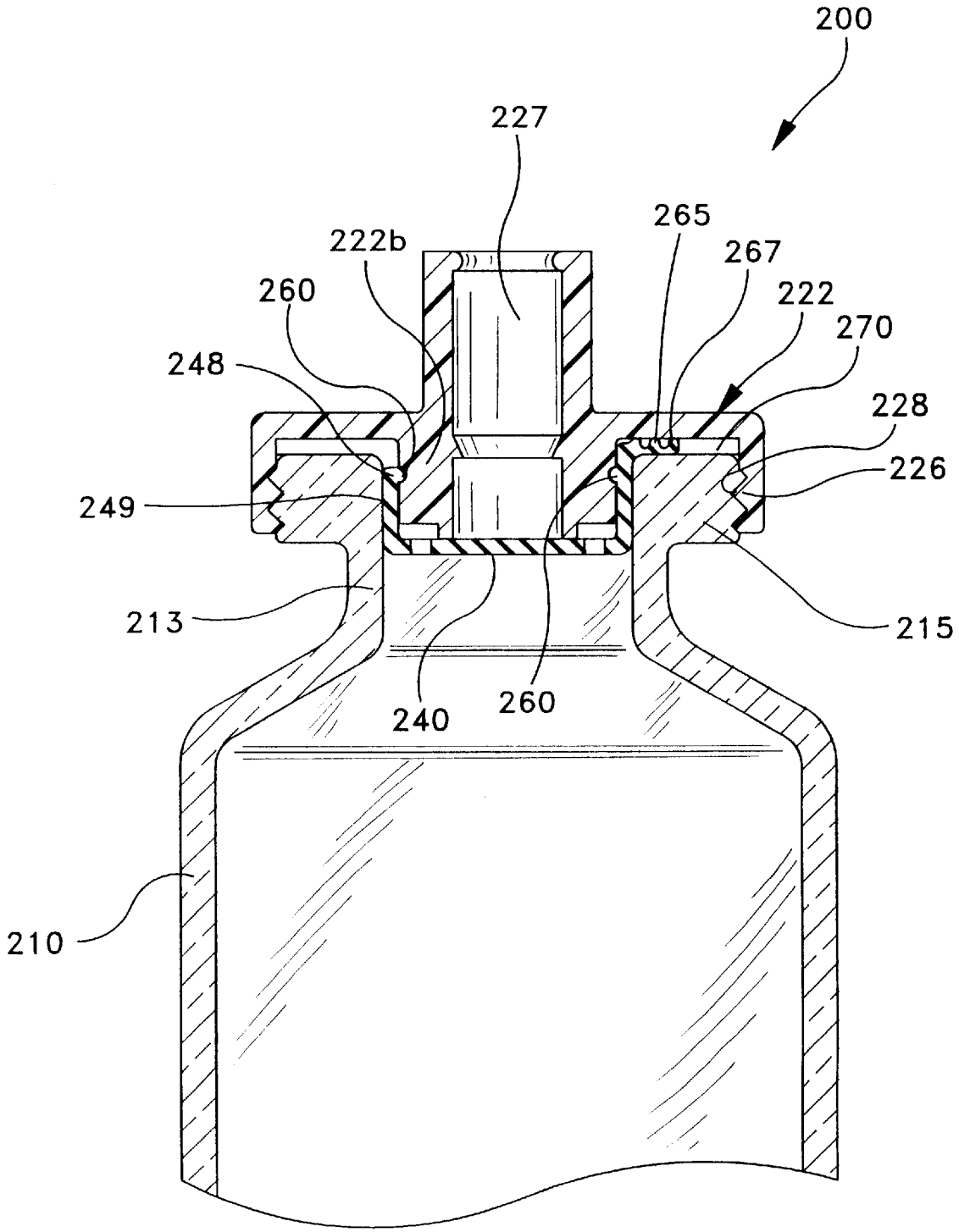
FIG. 21 illustrates an alternate way to retain the membrane.

Various structures may be incorporated to assist in the retention of membrane 40 between body 22 and the top surface of the bottle. For instance, ribs 46*a* (FIG. 17) may be incorporated onto edge 46 to provide extra grip between flat portion 22*a* and annular rim 15. Likewise, ribs 23 and/or ribs 15*a* (FIG. 18) may be incorporated on the flat portion and/or annular rim, respectively, for the same purpose. Alternately, as seen in FIG. 19, membrane 40 may include a flap 247 which is locked beneath annular rim 15 by the action of crimp cap 48. Likewise, the membrane might include a portion 249 wedged into a slot 25 defined in body 22 (FIG. 20), enhancing the gripping action of the crimp clamp. Other variations will be envisioned by the skilled artisan.

One or more fluid passages may be provided in the membrane to effect fluid communication between the recess and the open top of the bottle. In one configuration, the one or more fluid passages entail one or more openings 44 preferably defined on membrane 40 outside of central area 42. As seen in FIGS. 2–5, the one or more openings 44 are located on membrane 40 such that when the membrane is disposed in its closed position (FIGS. 2 and 5), sealing rib 30 will contact the membrane in a sealing area 43 defined between central area 42 and the one or more openings, thereby sealing recess 24 from fluid communication with open top 12 of the bottle. Additionally, membrane 40 may be designed or otherwise formed from an appropriate material such that when the membrane is in its closed position, the one or more openings 44 will rest flush against flat portion 22*a* of the body, further sealing the recess from the open top of the bottle.

It will be realized by the skilled artisan that in lieu of openings 44, the fluid passages can be formed as pre-pierced slits 44*a* (See FIG. 6A) provided through membrane 40. Alternately, as also seen in the figure, the fluid passages can be formed as pre-pierced, pinpoint-type punctures 44*b*. Slits 44*a* or punctures 44*b* are configured such that when membrane 40 is disposed in its open position, the slits/punctures will be stretched open to provide fluid access between the open top of the bottle and the recess. Likewise, when the membrane is disposed in its closed position, slits 44*a* or punctures 44*b* will close, thereby providing a self-sealing ability to enhance the sealing provided by rib 30.

Figure 8:
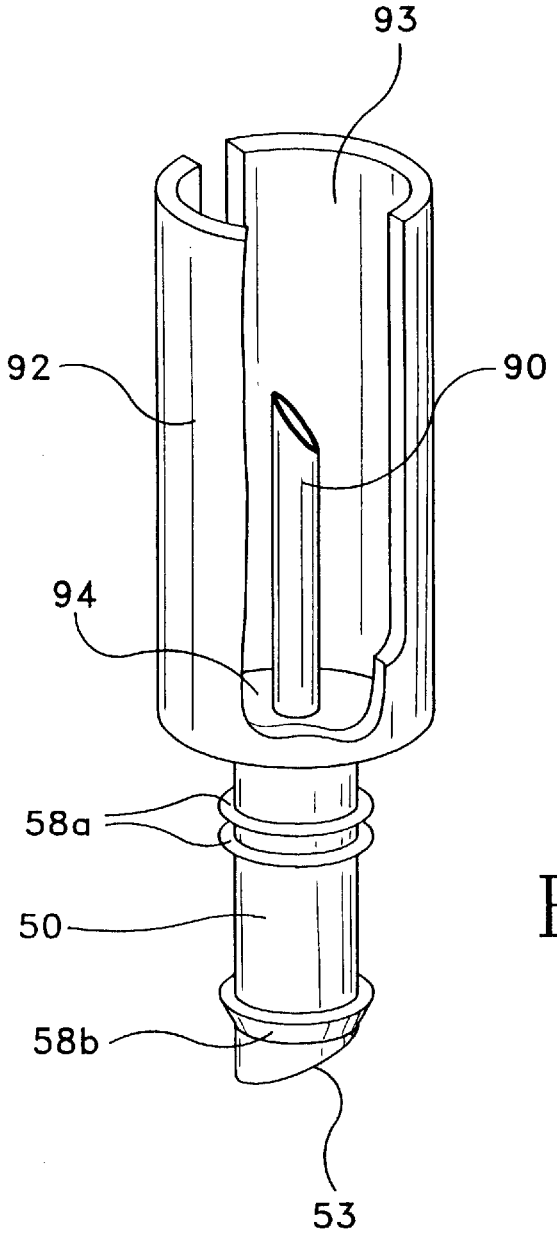
FIG. 8 depicts a needle assembly employable with the resealable bottle assembly of FIG. 2.
Figure 9:
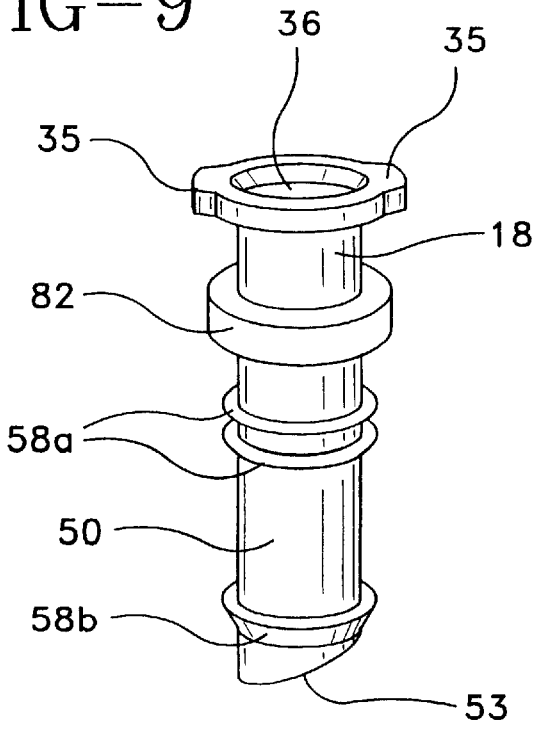
FIG. 9 depicts a luer lock assembly employable with the re-sealable bottle assembly of FIG. 2.
Figure 9A:
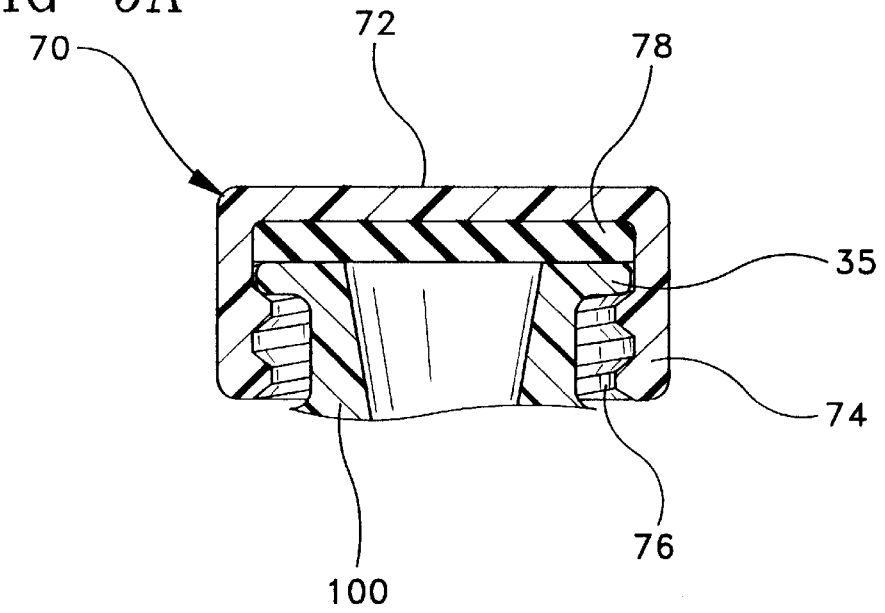
FIG. 9A depicts a seal for a luer lock hub.

Resealable bottle assembly 20 includes a means for introducing into or removing from bottle 10, fluids between a fluid source such as vial 60. The means for introducing or removing may entail, for example, a fluid access device 32. Fluid access device may be configured in a variety of configurations for fluid transfer to and from bottle 10. As seen in the foregoing figures, fluid access device 32 may be configured in a spike configuration for use with a fluid source 60 having a pre-slit plug or stopper 62. It will be equally realized by the skilled artisan that, if desired, fluid access device 32 can be configured as a needle assembly (see FIG. 8) or as a luer lock assembly (see FIG. 9), the principles of the invention being the same. Other configurations are also possible.

As herein depicted, fluid access device 32 includes a hollowed rod 50 having a proximal end 52, a distal end 53, and defining at least one fluid conduit 56 therethrough. Hollowed rod 50 is slidably disposed within orifice 24 of body 22 with a downstroke length "S" between storage (FIGS. 2 and 5) and actuated (FIG. 4) postions of fluid access device 32. Fluid conduit 56 communicates with both the proximal and distal ends of hollowed rod 50, and terminates at distal end 53 at an opening 53*a*. Distal end 53 of hollowed rod 50 is disposed for contact with central area 42 of the membrane. To promote fluid flow through conduit 56 and into or out of the distal end, distal end 53 may be sloped so as not to occlude opening 53*a*. It will be realized that a plurality of fluid conduits 56*a, b* (see FIG. 5A) may be provided through hollowed rod 50 (for instance, one fluid conduit 56*a* to vent air between bottle 10 and fluid source 60, the other fluid conduit 56*b* to permit liquid flow between the bottle and the fluid source). In this instance, sloping distal end 53 also establishes a difference in height between the fluid conduits, relative to membrane 40, permitting the simultaneous venting of air and liquid flow provided by the fluid conduits 56*a* and 56*b*, respectively.

Figure 4:
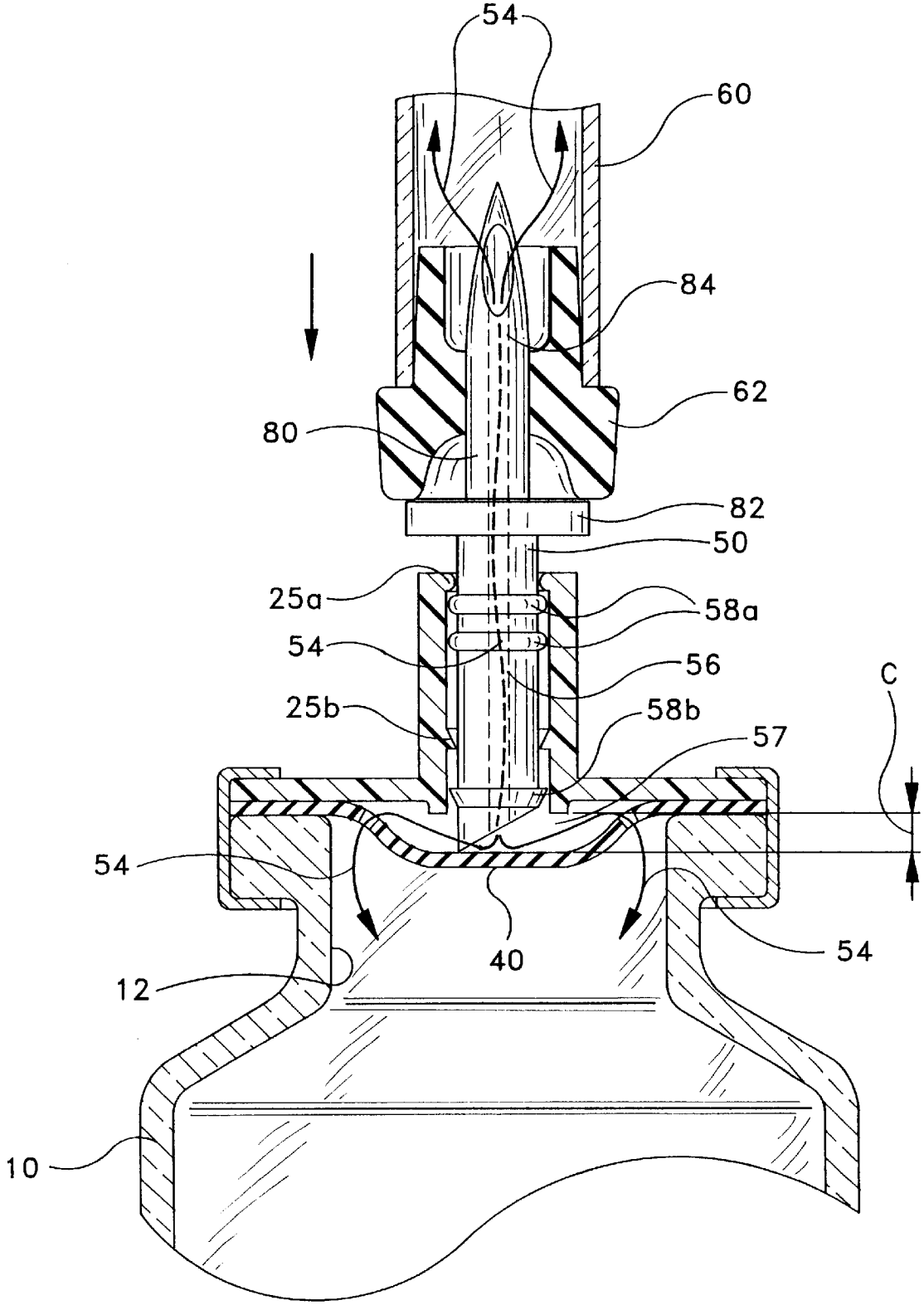
FIG. 4 is another cut-away view of the resealable bottle assembly depicted in FIG. 2, illustrating displacement of the membrane to its open position, thereby opening the fluid path between the recess an the open top of the bottle.
Figure 5:
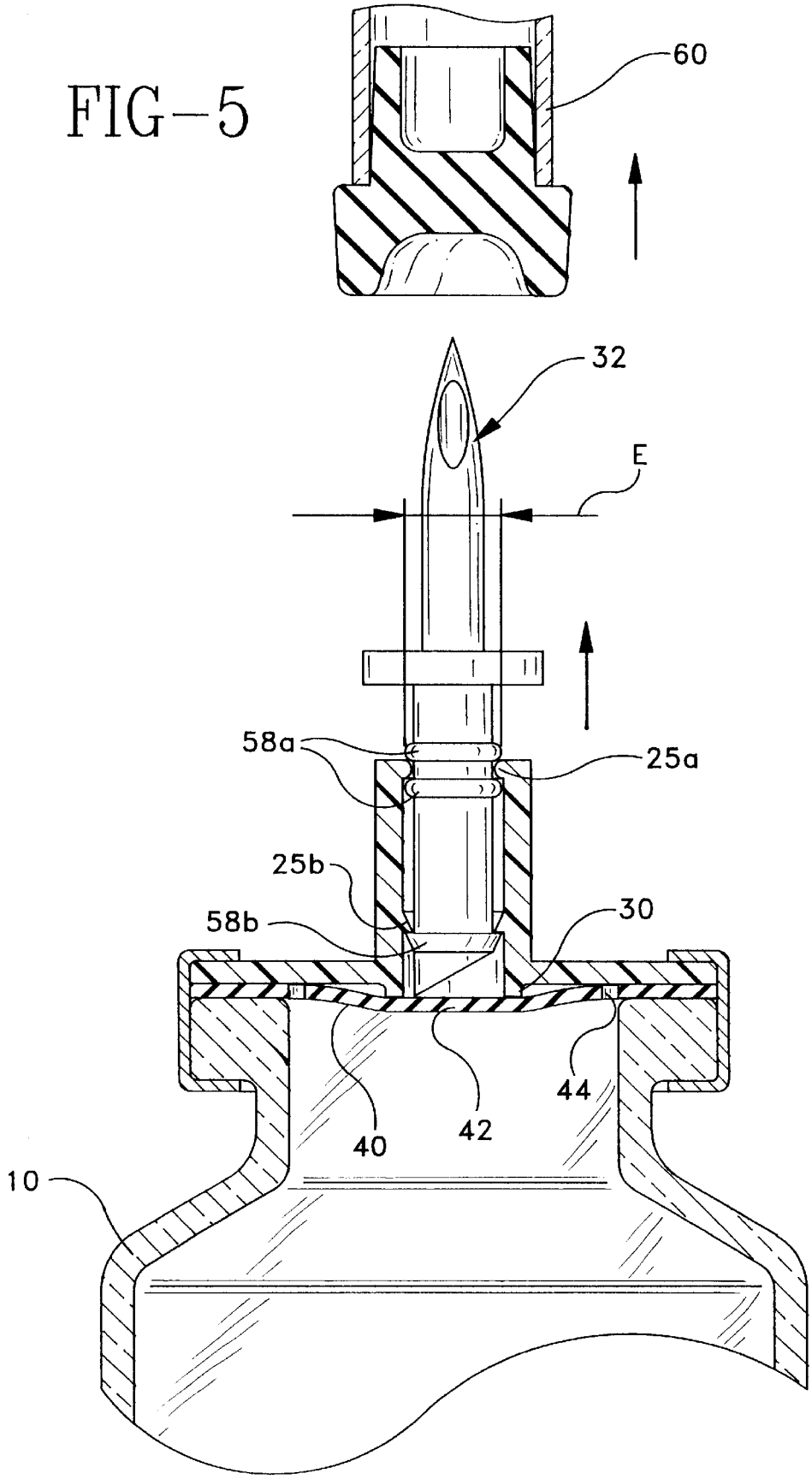
FIG. 5 is another cut-away view of the resealable bottle assembly of FIG. 2, illustrating removal of the fluid source and re-sealing of the membrane.
Figure 5A:
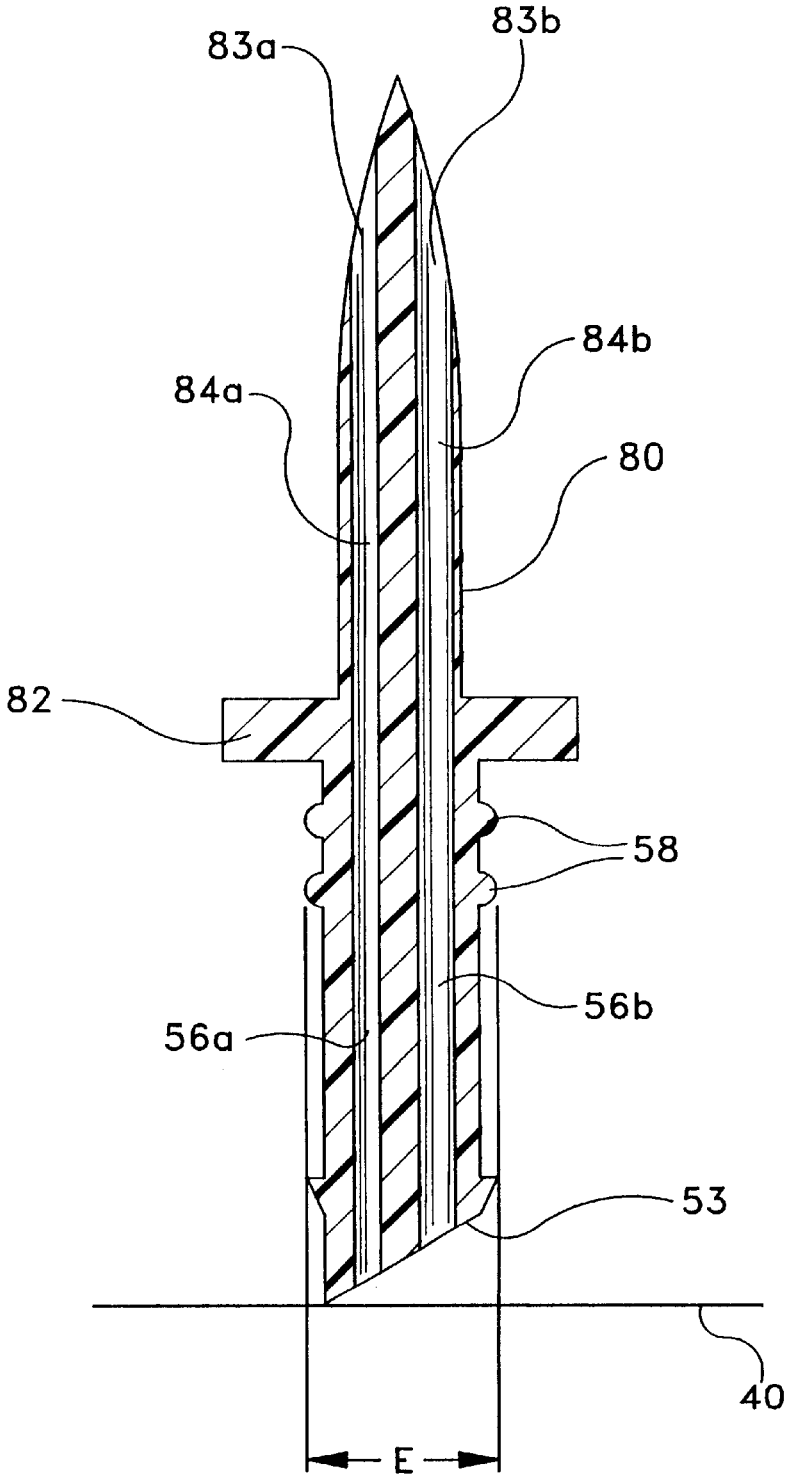
FIG. 5A depicts formation of more than one fluid conduit in the spike.

Hollowed rod 50 features a plurality of sealing gaskets 58 circumferentially disposed about the outside surface of the rod. While various configurations or numbers of sealing gaskets are possible, here, two spaced-apart sealing gaskets 58*a* are shown at the proximal end of rod 50, while a single sealing gasket 58*b* is shown at the distal end. Sealing gaskets 58, which can be integral with the formation or construction of hollowed rod 50 or can be provided separately such as by separately affixed O-rings, define an outside diameter "E" at least equal to if not slightly greater than width "A" of orifice 24. Thus, rod 50 may slide within orifice 24, while at the same time, sealing gaskets 58 providing sealing action between hollowed rod 50 and orifice 24. Sealing gaskets 58 are preferably disposed on hollowed rod 50 such that at least one sealing gasket is always retained in sealing relationship with orifice 24, preventing contaminants introduced into orifice 24 through top end 26 from entering into bottle 10 through bottom end 28, preserving sterility of the device in either the storage (FIGS. 2 and 5) or actuated (FIG. 4)

positions. To better preserve the sterility of drug 16 where multiple actuations of fluid access device 32 are contemplated, an additional sealing gasket 58*c* (FIG. 5B) may be incorporated between sealing gaskets 58*a* and 58*b*, as described hereinbelow.

To facilitate retention of fluid access device 32 in the actuated or storage positions, one or more sealing locks 25 can be provided in orifice 24. As herein depicted, one sealing lock 25*a* is located adjacent the proximal end of the orifice, while a sealing lock 25*b* is located adjacent the distal end of the orifice. Sealing lock 25*a* is configured to be releasably engaged between sealing gaskets 58*a* of the rod, while sealing lock 25*b* features a flat, distally-facing edge engageable with sealing gasket 58*b* to prevent inadvertent withdrawal of rod 50 from orifice 24. Sealing lock 25*a* cooperates with sealing gaskets 58*a*, while sealing lock 25*b* cooperates with sealing gasket 58*b*, to retain the rod in either its activated (FIG. 4) or storage (FIGS. 2 and 5) positions. Sealing locks 25, which like sealing gaskets 58 can be integrally formed or provided as O-rings, are designed to engage an appropriate sealing gasket 58 to retain hollowed rod 50 either in the storage position (FIGS. 2 and 5) or in the activated position (FIG. 4) depending on usage desired by the practitioner. It will also be appreciated by the skilled artisan that, if desired, the sealing gaskets may be provided in the orifice, with the sealing locks provided on the rod. Also, the sealing gaskets can be provided on both the orifice and the rod, if desired.

Figure 5B:
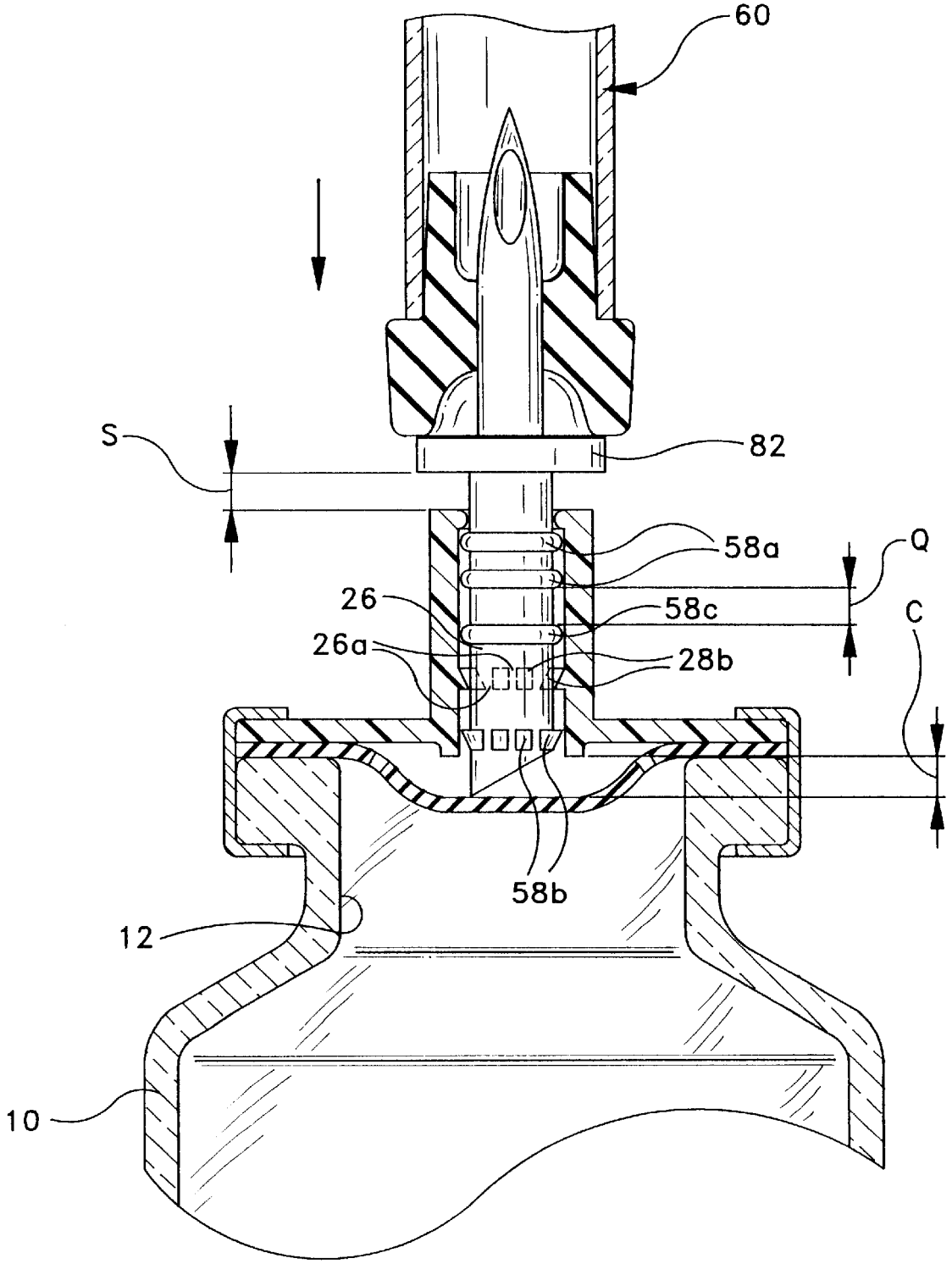
FIG. 5B illustrates an alternate formation of the the fluid access device.

Particularly where fluid access device 32 is configured as a spike assembly having separate fluid conduits 56*a*, 56*b* for air and liquid flow (FIG. 5A), it has been seen that the "downstroke" of rod 50 when urging fluid access device 32 from its storage position to its activated postion acts as a a pumping effect to initiate fluid flow between fluid source 60 and fluid access device 32. It is believed that the the reason for this pumping effect is that air within bottle 10 is slightly pressurized during downstroke of fluid access device 32, and that the resultant pressure fluctuation within bottle 10 is desirable to cause the initiation of fluid flow between fluid source 60 and bottle 10. Referring to FIG. 5B, if desired, to better facilitate the pressure fluctuation, structure can be incorporated to enhance the pressure fluctuation effect generated by the downstroke of fluid access device 32. FIG. 5B illustrates that both sealing gasket 58*b* and and sealing lock 28*b* can be formed in a discontinuous manner, providing one or more passages 26*a* communicating the open top of bottle 10 with a chamber 26 defined in orifice 24. While chamber 26 can be defined in orifice 24 between one of sealing gaskets 58*a* and bottom end 28 of the orifice, here, chamber 26 is the portion of orifice 24 between a sealing gasket 58*c* located between the sealing gaskets 58*a* and 58*b* and the bottom end 28 of the orifice. During downstroke of the fluid access device to the actuated position, air contained within chamber 26 will be displaced to bottle 10, enhancing the pressure fluctuation displayed by bottle 10, and facilitating the initiation of fluid flow through fluid access device 32 between bottle 10 and fluid source 60.

Sealing gasket 58*c* can be provided whether or not discontinuous sealing gasket and sealing lock 58*b*, 28*b* and chamber 26 are provided. Particularly where multiple actuations of fluid access device 32 are envisioned, FIG. 5B illustrates that the distance "Q" between sealing gasket 58*a* and 58*c* should be greater than the stroke length "S" of the fluid access device 32, such that any contaminants tracked along the walls of orifice 24 by sealing gaskets 58*a* during a downstroke of rod 50 are not contacted by sealing gasket 58*c* on an upstroke, preventing sealing gasket 58*c* from further tracking the contaminants distally in orifice 24 during a subsequent actuation (downstroke) phase. Also, because the sterility of sealing gasket 58*c* is preserved, where a discontinuous sealing gasket 58*b*/sealing lock 28*b* is provided contaminants are prevented from entering open top 12 of the bottle via passages 26*a*.

Figure 9B:
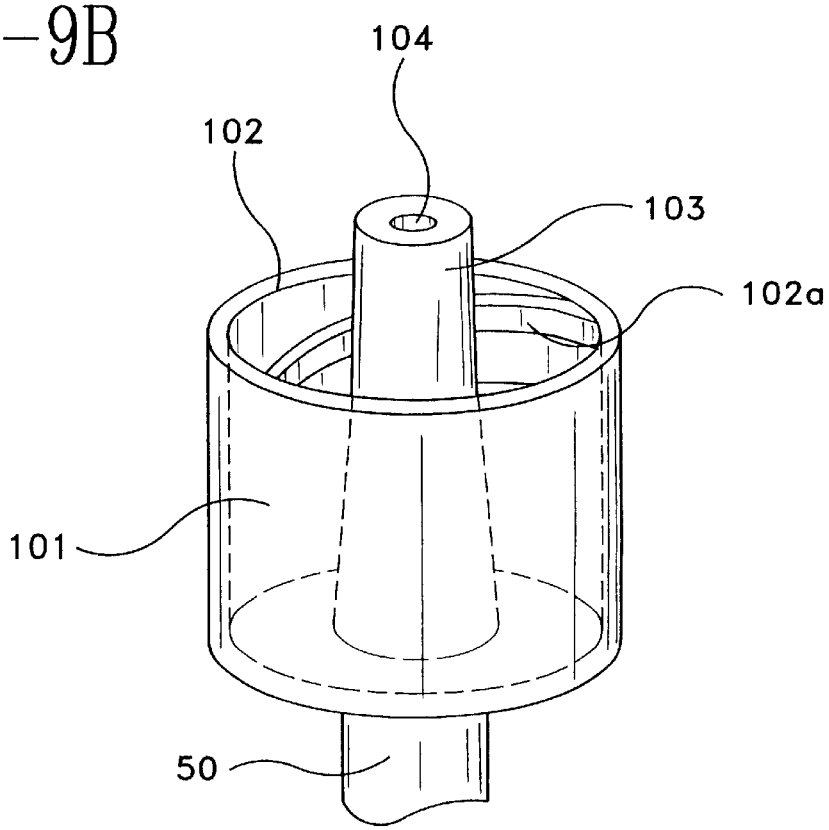
FIG. 9B depicts a luer lock tip assembly employable with the resealable bottle assembly of FIG. 2.

As previously discussed, fluid access device 32 can be configured as a needle assembly (FIG. 8), as a luer lock assembly (FIG. 9) or, as principally depicted in the FIGS. 2–5, as a spike assembly. To promote interchangeablity of the variously configured fluid access devices with the body provided for the connector assembly, each of the fluid access devices shares a common rod 50 as previously described. Configurational differences in structure are provided through the means for communicating fluid to and from rod 50 that is incorporated with the fluid access device. In FIGS. 2–5, the means for communicating fluid comprises a spike 80. Spike 80 is affixed adjacent proximal end 52 of the hollowed rod, and includes an opening 83 communicating with its own lumen 84 that is in fluid communication with fluid conduit 56. While for the sake of simplicity spike 80 as depicted in FIGS. 2–5 has bee illustrated with a single opening 83 and lumen 84, it is within the purview of the present invention that spike 80 include separate openings 83*a*, 83*b* and separate lumens 84*a*, 84*b* to facilitate air and liquid flow as depicted, for instance, in U.S. Pat. No. 5,358,501 to Meyer. As previously described, rod 50 would include separate fluid conduits 56*a*, 56*b* communicating with the separate lumens 84*a*, 84*b* (see FIG. 5A). A base portion 82 is preferably affixed about proximal end 52 of the hollowed rod 50 as a type of pressure surface upon fluid access device 32 is urged to the open position.

Where fluid access device is configured as a needle assembly (see FIG. 8,) a needle 90 is provided in lieu of spike 80. Needle 90 is in fluid communication with fluid conduit 56 of the hollowed rod. A needle guard 92 having an open proximal end 93 may be circumferentially provided around needle 90. Needle guard 92 is configured to accept the introduction of various I.V. components, vial components, or the like, through open proximal end 93 for mating with needle 90. Needle guard 92 features a base portion 94 adjacent proximal end 52 of hollowed rod 50 as a support surface. Where fluid access device 32 is configured as a luer lock assembly (FIG. 9), a luer lock hub 100 may be provided in lieu of spike 80. Luer lock hub 100, as the skilled artisan will appreciate, features an opening in fluid communication with fluid conduit 56 of hollowed rod 50, and an edge 35 connectable to a typical luer lock syringe (not shown). Luer lock hub 100 can also be used to accept luer slip syringes. Also, as illustrated in FIG. 9B, a luer lock tip 101 could be substituted for specific use with various luer connections. Luer lock tip 101 includes a luer lock collar 102 having a thread 102*a* for securing the luer lock tip to various luer connections. A luer tip 103 includes a lumen 104 in fluid communication with fluid conduit 56 of rod 50. It will be also evident to the skilled artisan that other types or connector devices could be employed. It will be seen that by providing a common rod configuration, the device is extremely flexible, permitting the manufacture of a common body 22 for any assembly of fluid access device desired.

Various caps (not illustrated) may be provided to seal the device from the ambient environment. The caps may cover the fluid access device and rim 15 so as to engage with a portion of bottle 10, for instance, by a tamper evident seal. If a needle assembly or spike assembly is incorporated as part of the fluid access device, these may likewise be provided with suitably configured needle or spike shields, respectively, to further maintain sterility of the respective needle or spike, until access to the device is desired. Where fluid access device 32 is provided as a luer lock assembly (FIG. 9), resealable bottle assembly 20 may further include an external seal 70 for preserving the sterility of the various components, inclusive of drug 16, pending use. In one configuration, seal 70 features a circular end wall 72, and a cylindrical side wall 74 with an internal thread 76 configured for threadably engaging edge 35 provided with luer connector hub 100. A suitable sealing material 78, such as a rubber seal, may be secured to the interior face of circular end wall 72. Accordingly, seal 70 can be threadedly engaged onto luer connector hub 100 and tightened such that sealing material 78 sealingly engages the open connector end of the luer connector hub. Thus, a barrier is established against the passage of contaminants or other unwanted material through the luer hub which (if otherwise uncovered), would provide communication through orifice 24 and, potentially, through open top 12 of bottle 10.

When a practitioner desires to either introduce fluid to drug 16 held within bottle 10 or remove fluid from the bottle, any luer lock seals, conventional caps, needle shields or spike shields, or the like may be removed, exposing fluid access device 32. It will be seen that rod 50 is in its storage position, with sealing lock 25*a* captured between the spaced-apart sealing gaskets 58*a*, and sealing gasket 58*b* located proximal of sealing lock 25*b*. By the force exerted by fluid source 60 upon base portion 82, hollowed rod 50 is urged towards the interior of bottle 10 to place same in the activated position. With distal end 53 of rod 50 engaged against central area 42 of the membrane, it will be seen that the rod urges membrane 40 towards the interior of bottle 10, displacing the membrane to its open position. Both of sealing gaskets 58*a* as well as sealing gasket 58*b* are urged distally of sealing locks 25*a* and 25*b*, such that the force urged by the distal surfaces of the sealing locks upon the sealing gaskets retains rod 50 in the open position. A gap 57 having a width "C" is created between sealing rib 30 and central area 42, thereby opening fluid path 54 between open top 12 of the bottle and orifice 24 of the body. With the opening of fluid path 54, fluid flow is fully enabled between vial 60 and the interior of bottle 10 via: fluid conduit 56 and distal end 53 of the rod; gap 57; and the one or more openings 44 provided in membrane 40.

A practitioner may keep fluid source 60 attached to fluid access device 32 for a time sufficient to provide a desired quantity of fluid to the interior of bottle 10. Thereafter, the practitioner may deliver the now-reconstituted 16 held in the interior of bottle 10 by keeping fluid path 54 open. In this regard, sealing gaskets 58 of the rod cooperate with sealing locks 25 of the orifice to retain the rod in the open position, such that the reverse fluid flow is possible—i.e., drug 16 may flow out of bottle 10 via: the one or more openings 44; gap 57; distal end 53 of the rod; and fluid conduit 56 through the rod. The drug 16 may thus be readily administered into an I.V. bag, line or the like by a practitioner, where desired.

Where it is not desired or necessary to utilize all of drug 16 held within bottle 10, the practitioner may simply reseal bottle 10 by urging rod 50 back to its storage position. As exemplified by FIG. 5, a user may either directly apply or cause to be applied a proximally directed force upon fluid access device 32, urging sealing gaskets 58*a* and 58*b* proximally and pulling rod 50 upwards in orifice 24 towards its storage position. Sealing gaskets 58*a* will engage around sealing lock 25*a*, while sealing gasket 58*b* will be blocked by sealing lock 25*b*, preventing rod 50 from inadvertent withdrawal from orifice 24 and retaining rod 50 in the storage position. Membrane 40 will resiliently deflect upwards towards its closed position. Orifice 24 will be sealed from open top 12 of the bottle via sealing engagement between membrane 40 and sealing rib 30. Fluid path 54 will thus be closed, isolating the interior of bottle 10 from exposure with the ambient environment, thereby preserving the sterility of any drug 16 still remaining within the bottle. Also, as previously explained, depending upon the design and resiliency characteristics of membrane 40, openings 44 will also be disposed for contact with flat portion 22*a* of body 22, further preventing inadvertent fluid flow between recess 24 and open top 12 of the bottle and helping to isolate drug 16 from the ambient environment.

Figure 14:
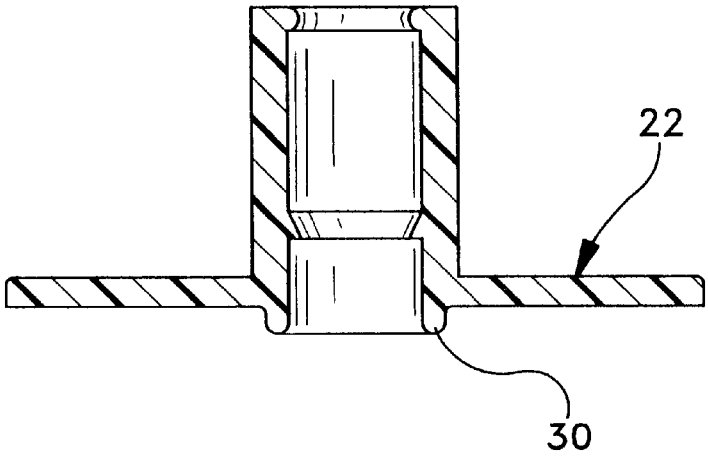
FIGS. 14–16 depict various alternate configurations for the sealing rib.
Figure 15:
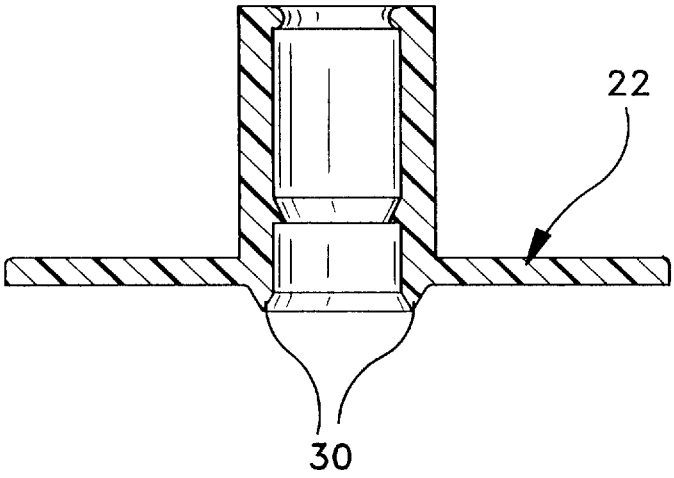
Figure 16:
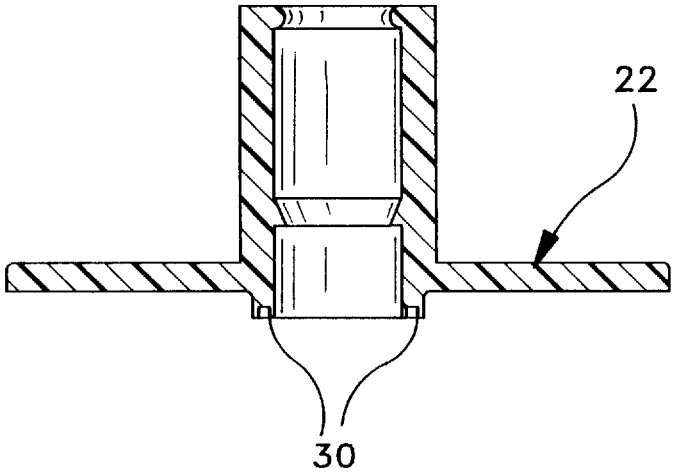

Various features depicted may be configured in alternate manners. For example, sealing rib 30 is depicted herein with a squared cross-section. However, it will be apparent to the skilled artisan that the sealing ribs may also display rounded (FIG. 14*a*) cross-sections, peaked or pointed (FIG. 15) cross-sections, or any suitable configuration ensuring sealing contact between rib 30 and membrane 40. Moreover, while for ease of illustration a single sealing rib 30 has been shown, it will be apparent that more than one concentric sealing rib (FIG. 16*c*) may be disposed about the periphery of bottom end 28 of the respective orifice.

Figure 6:
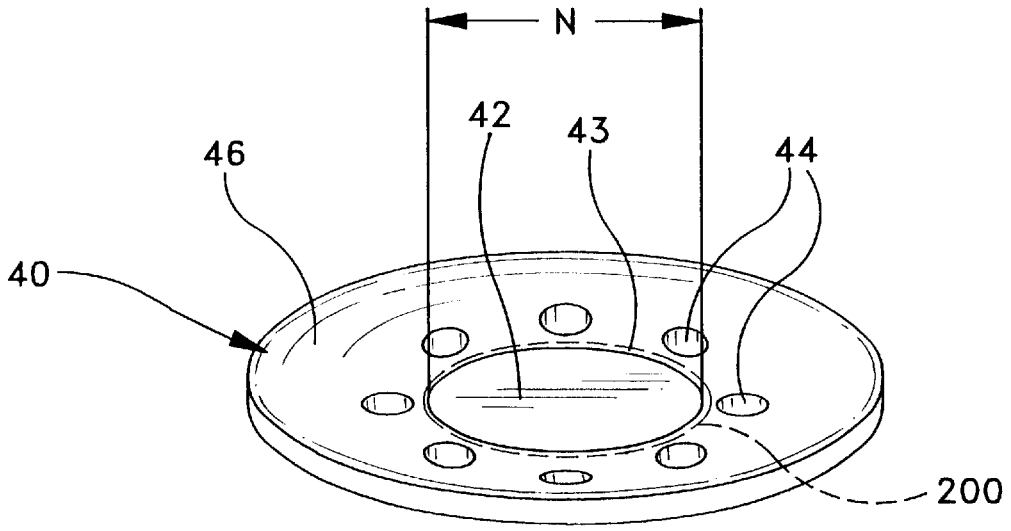
FIG. 6 depicts one embodiment of the membrane illustrated in FIGS. 2–4.
Figure 6A:
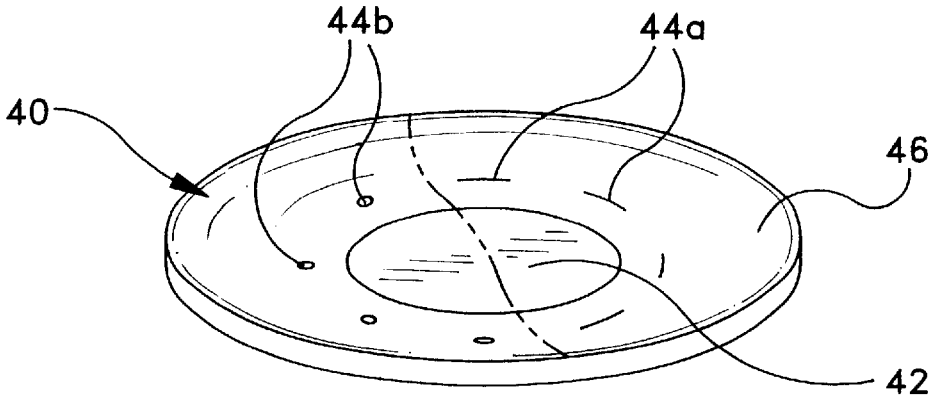
FIG. 6A illustrates a variant of the membrane illustrated in FIG. 6.
Figure 7:
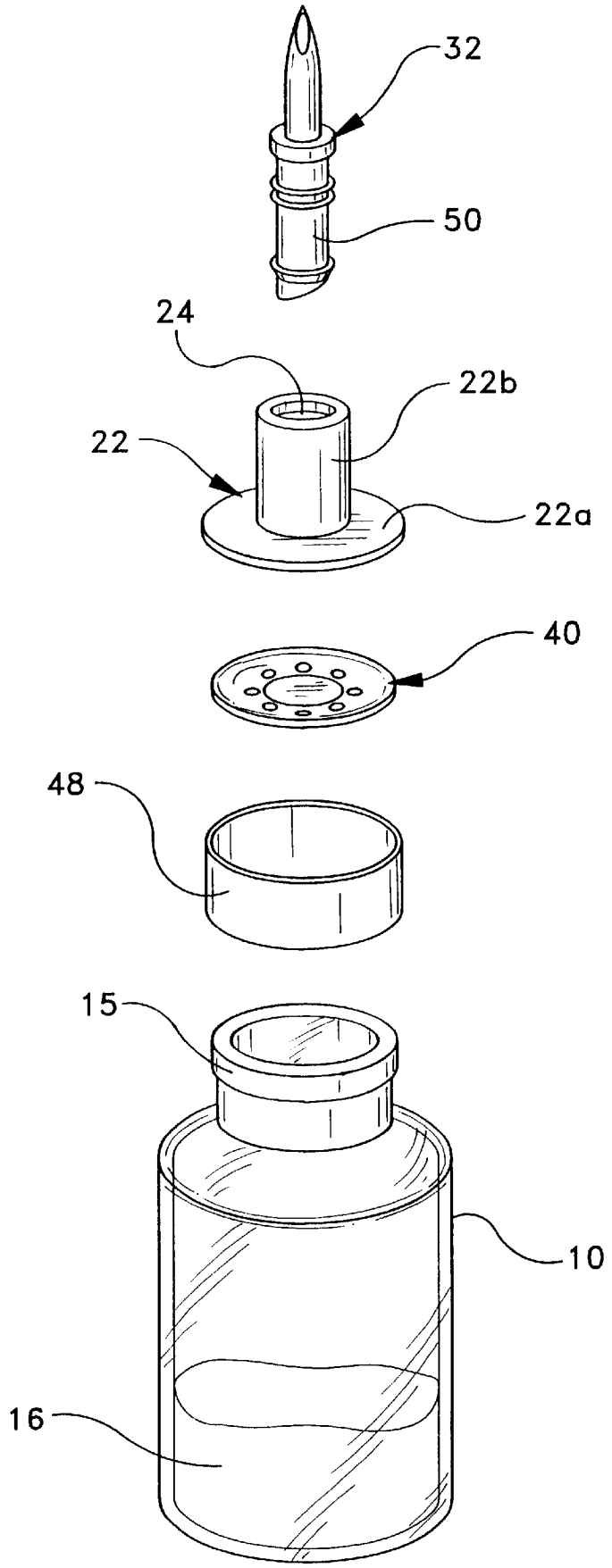
FIG. 7 is an exploded perspective view of the resealable bottle assembly depicted in FIGS. 2–5.

If desired, it will be apparent to the skilled artisan that in lieu of a sealing rib 30 formed with the body, a sealing rib 200 may be formed as part of the structure of membrane 40 itself (see FIG. 6). Sealing rib 200 may be located between the one or more openings 40 and central area 42. Thus, rib 200 will be urged into sealing contact with flat portion 22*a* of the respective body when membrane 40 returns to its closed position.

The various components associated with the body or the fluid access device may be molded or otherwise formed from medical grade plastics, glass, or like materials. Similarly, bottle 10 may be either plastic or glass, as is conventional.

Figure 10:
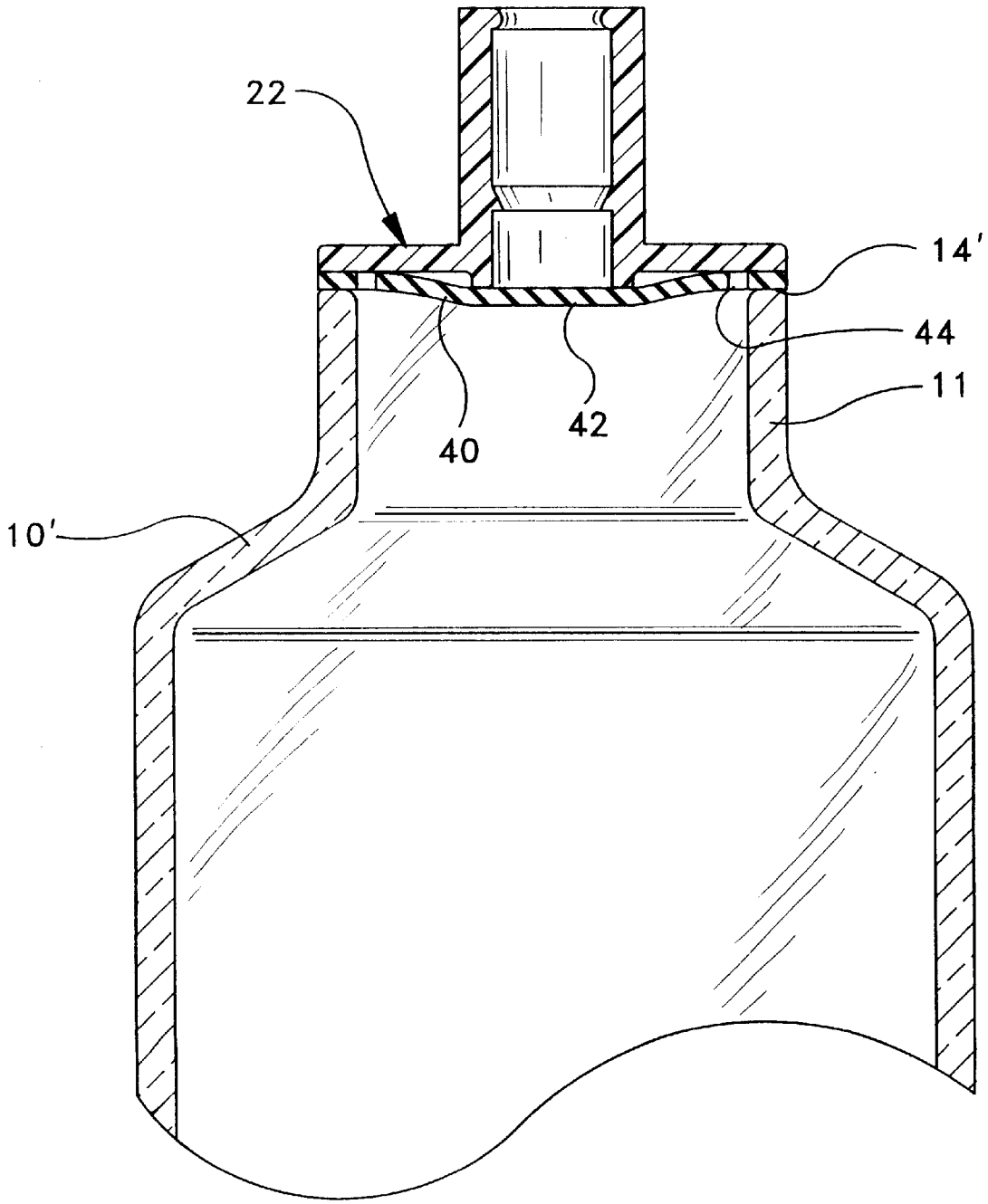
FIG. 10 depicts a rimless bottle employable with the resealable bottle assembly of the present invention.

The principles of the invention are equally applicable to a rimless bottle 10', where a top surface 14' may be encompassed by the uppermost area of wall 11 surrounding open top 12' (see FIG. 10). Here, membrane 40 and body 22 are directly affixed to top surface 14', for instance, by welding, adhesives, or mechanical methods of affixation.

Figure 11:
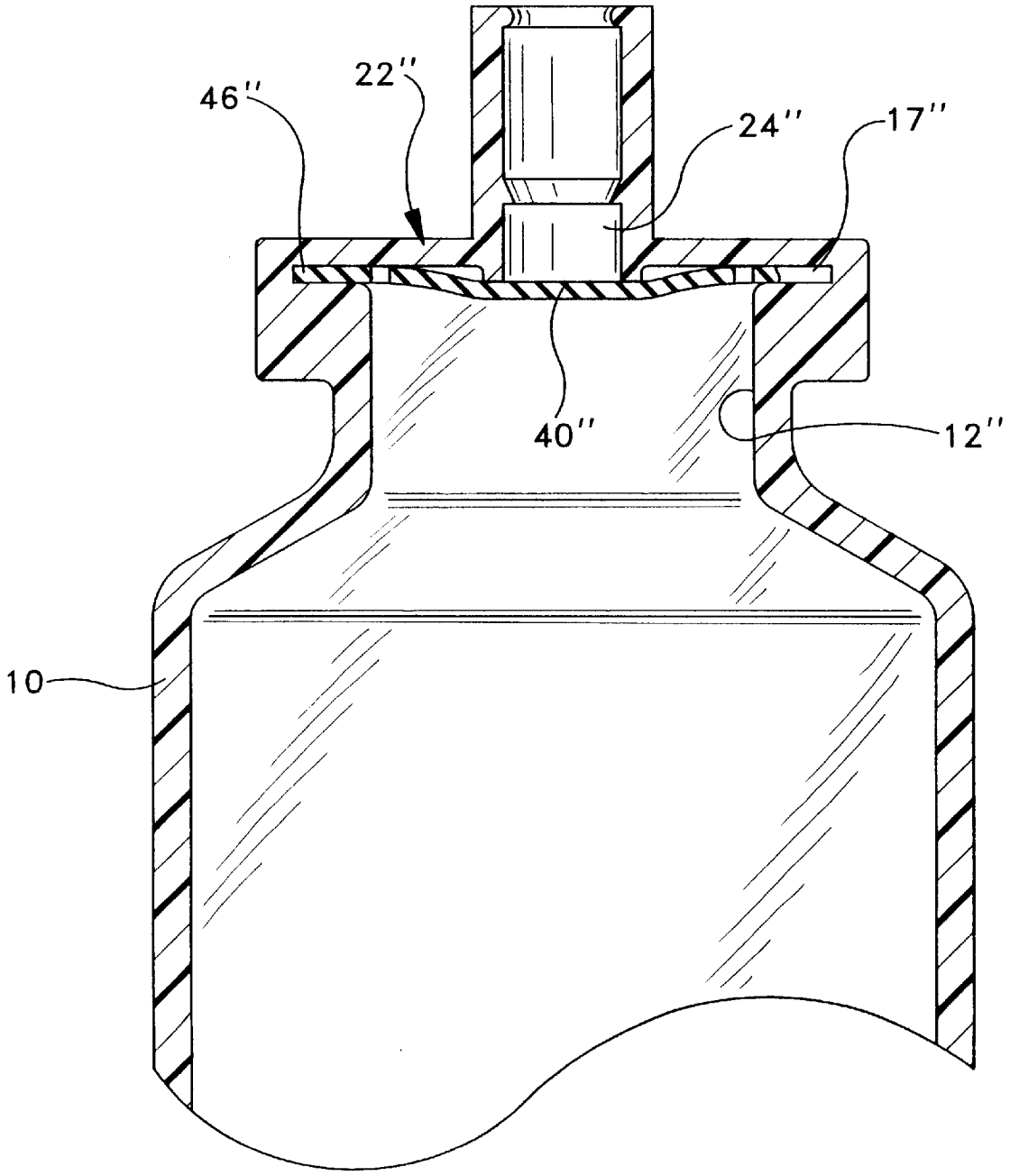
FIG. 11 illustrates unitary manufacture of a body and bottle, and retention of the membrane therein, in accordance with the present invention.

It will also be evident to the skilled artisan that if, as previously described, body 22 and bottle 10 are unitarily formed, membrane 40 may be formed with them, for instance, by a suitable co-injection process. Likewise, if membrane 40 is supplied separately from a unitarily formed bottle 10"/body 22" (or 122"), membrane 40" may be secured across the interface between orifice 24" and open top 12" of the bottle, for instance, by supporting edges 46" of membrane 40" in a gap or annulus 17" defined by unitary bottle 10"/body 22" (or 122") (see FIG. 11).

Figure 13:
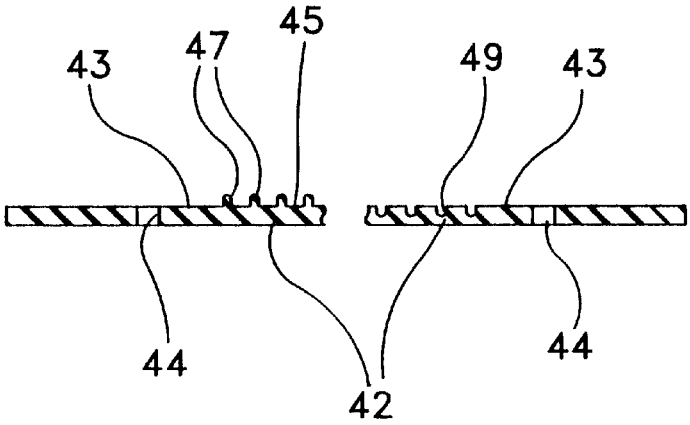
FIG. 13 depicts the incorporation of fluid channels in the central area of the membrane.

Also, if desired, to enhance the efficiency of fluid flow between the bottom surface of the pusher and central area 42 of the membrane, particularly when the fluid conduit defined by the rod directly communicates with the central area, one or more channels 43 may be provided on the central area (See FIG. 13). Channels 43 can entail spaces 45 defined between ribs 47 formed on the central area, or channels 49 incorporated in the structure of central area 42.

Moreover, it will be realized that the membrane need not be secured between the body and the top surface of the bottle. For instance, the membrane could be associated with the body itself and engaged across the open top of the bottle, for instance, by being secured in the neck of the bottle. FIG.

21 illustrates an embodiment 200 of the resealable bottle assembly substantially as hereinbefore described, albeit configured to retain the membrane against the neck of the bottle. A body 222 is provided, having a downwardly extending portion 222*b* that defines an orifice 227. As hereinbefore described, hollowed rod 250 is disposed in orifice 227. Downwardly extending portion 222*b* is configured for insertion into neck portion 213 of bottle 210. Membrane 240 includes an annular bead 248 retained between neck portion 213 and a complementary groove 260 formed on downwardly extending portion 222*b*. One or more annular ribs 249 may also be provided on membrane 240 distal of annular bead 248. While body 222 may be secured to annular rim 215 via a crimp cap, as here shown, body 222 is threadedly secured to annular rim 215 via complementary threads 228, 226 formed on the annular rim and sidewall 227 of the body, respectively. As in the previously described embodiments, membrane 240 rests between the bottom end of the orifice and the open top of the bottle for opening and closing of the fluid path. It will be realized that by this configuration, annular bead 248 and, if provided, the one or more annular ribs 249 may also act as a stopper for bottle 210. It will also be realized that, if desired, membrane 240 may be extended via a portion 265 that is trapped in a gap 270 between body 222 and annular rim 215. Portion 267 may feature one or more ribs 267 to enhance sealing contact between the membrane, the body and the annular rim.

It will be appreciated and understood by those skilled in the art that further and additional forms of the invention may be devised without departing from the spirit and scope of the appended claims, the invention not being limited to the specific embodiments shown

We claim:

1. A resealable container assembly, comprising:

a container having an open top, an interior in fluid communication with said open top, and a top surface disposed around portions of the container surrounding said open top;

a body disposed adjacent the top surface of the container, said body defining an orifice having a fluid path with the open top of the container, said orifice having a width, a height, and a periphery adjacent the open top of the container;

a membrane disposed between the open top of said bottle and the orifice defined by said body, said membrane having a sealing area for sealing contact with the periphery of the orifice and defining one or more fluid passages outside of said sealing area for fluid communication between the orifice and the open top of the container, wherein said membrane is displaceable between a sealing position to close the fluid path between the orifice and the open top of the container, and an open position to open the fluid path between the orifice and the open top of the container; and a fluid access device disposed in the orifice defined by said body, said fluid access device having a rod disposed between storage and activated positions in sliding fluid-tight relationship with the orifice, said rod having a proximal end, a distal end, and a fluid conduit therebetween, said distal end configured for canted contact with the membrane to prevent the occlusion of fluid flow between the distal end and the membrane, and means affixed to the proximal end of the rod for communicating fluid to and from the rod, wherein a force urged against the means for communicating fluid will urge the rod from the storage position to the activated position to displace said membrane to the open position.

2. The resealable container assembly of claim 1, wherein said membrane comprises an elastomeric element supported between said body and the top surface of the container.

3. The resealable container assembly of claim 1, wherein said body includes a portion insertable through the open top of the container, said membrane comprising an elastomeric element extended across the recess between said body portion and the open top of the container.

4. The resealable container assembly of claim 1, wherein said one or more fluid passages comprise one or more openings.

5. The resealable container assembly of claim 1, wherein said one or more fluid passages comprise one or more slits.

6. The resealable container assembly of claim 1, where said one or more fluid passages comprise one or more pre-pierced punctures.

7. The resealable container assembly of claim 1, wherein said means for communicating fluid comprises a spike.

8. The resealable container assembly of claim 1, wherein said means for communicating fluid comprises a needle.

9. The resealable container assembly of claim 1, wherein said means for communicating fluid comprises a luer lock hub.

10. The resealable container assembly of claim 1, wherein said means for communicating fluid comprises a luer lock tip.

11. A resealable container assembly, comprising:

a bottle having an open top, an interior in fluid communication with said open top, and a top surface disposed around portions of the bottle surrounding said open top;

a body disposed adjacent the top surface of the bottle, said body defining an orifice having a fluid path with the open top of the bottle, said orifice having an inside surface, a width, a height, one or more sealing locks disposed along the inside surface, and a periphery adjacent the open top of the bottle;

a membrane disposed between the open top of said bottle and the orifice defined by said body, said membrane defining a central area having a width at least equal to the width defined by the orifice, one or more fluid passages outside of said central area for fluid communication between the orifice and the open top of the bottle, and a sealing area for sealing contact with the periphery of the orifice, wherein said membrane is displaceable between a sealing position wherein said sealing area is disposed against the body to close the fluid path between the orifice and the open top of the bottle, and an open position wherein said sealing area is urged away from the body to open the fluid path between the orifice and the open top of the bottle; and a fluid access device disposed in the orifice defined by said body, said fluid access device having a rod disposed between activated and storage positions in sliding, fluid-tight relationship with the orifice, said rod having a length, a proximal end, a distal end, and a fluid conduit therebetween, one or more sealing gaskets disposed along the length of the rod for sealing engagement with the inside surface of the orifice, said distal end disposed for contact with the membrane, and means affixed to the proximal end of the rod for communicating fluid to and from the rod, wherein a force urged against the fluid access device will urge the rod from its storage position to its activated position to displace the membrane to the open position, and wherein a proximally directed force on said fluid access device will urge the rod from its activated position to its storage position to return the membrane to its sealed position.

12. The resealable container assembly of claim 11, wherein said fluid access device comprises a luer connector hub.

13. The resealable container assembly of claim 11, wherein said fluid access device comprises a spike.

14. The resealable container assembly of claim 11, wherein said fluid access device comprises a needle.

15. The resealable container assembly of claim 11, wherein said body and said top surface are formed as a unitary component.

16. The resealable container assembly of claim 15, wherein said membrane comprises an elastomeric element supported between said body and the top surface of the bottle.

17. The resealable container assembly of claim 11, wherein said membrane comprises an elastomeric element supported between said body and the top surface of the bottle.

18. The resealable container assembly of claim 11, wherein said body includes a portion insertable through the open top of the bottle, said membrane comprising an elastomeric element extended across the orifice and between said body portion and the open top of the bottle.

19. The resealable container assembly of claim 11, further comprising a sealing rib disposed about at least a portion of the periphery of said recess for contact with said sealing area of the membrane.

20. The resealable container assembly of claim 11, further comprising a plurality of sealing ribs disposed about at least a portion of the periphery of said recess for contact with said sealing area of the membrane.

21. The resealable container assembly of claim 11, further comprising a sealing rib disposed on said membrane for contact with said body outside of the periphery defined by said recess.

22. The resealable container assembly of claim 11, wherein said top surface of the bottle comprises an annular rim disposed about the open top of said bottle.

23. The resealable container assembly of claim 22, further comprising a crimp cap for securing said body to said annular rim.

24. The resealable container assembly of claim 11, wherein said one or more sealing gaskets on said rod cooperate with said one or more sealing locks in the orifice to releasably retain said rod in the open or sealing positions.

* * * * *